US005983798A

United States Patent [19]

Iijima et al.

[11] Patent Number: 5,983,798

[45] Date of Patent: Nov. 16, 1999

[54] DOCTOR BLADE APPARATUS

[75] Inventors: Takashi Iijima, Yokosuka; Yosuke Nobuta, Yokohama, both of Japan

[73] Assignee: Tokyo Kikai Seisakusho, Ltd, Tokyo, Japan

[21] Appl. No.: 09/246,161

[22] Filed: Feb. 8, 1999

[30] Foreign Application Priority Data

May 15, 1998 [JP] Japan ..... 10-150775

[51] Int. Cl.[6] ..... B41F 31/04

[52] U.S. Cl. ..... 101/365; 101/169

[58] Field of Search ..... 101/365, 350.1, 101/350.5, 350.6, 349.1, 169, 363, 485, 157

[56] References Cited

U.S. PATENT DOCUMENTS

| | | | |
|---|---|---|---|
| 4,402,264 | 9/1983 | Weisgerber | 101/365 |
| 4,495,864 | 1/1985 | Junghans | 101/365 |
| 4,587,899 | 5/1986 | Theilacker | 101/365 |
| 5,383,395 | 1/1995 | Buschulte | 101/365 |
| 5,694,851 | 12/1997 | Bruni | 101/365 |
| 5,832,830 | 11/1998 | Rancourt et al. | 101/365 |
| 5,842,416 | 12/1998 | Olawsky et al. | 101/350.1 |
| 5,857,412 | 1/1999 | Roskosch et al. | 101/365 |

FOREIGN PATENT DOCUMENTS 6-75963 9/1994 Japan .

OTHER PUBLICATIONS

Newspaper Printing Handbook—The Japan Newspaper Publishers and Editors Association, pp. 67, 68, 178, 189; Apr. 10, 1997. (See p. 2 of the specification).

*Primary Examiner*—Christopher A. Bennett
*Attorney, Agent, or Firm*—Armstrong, Westerman, Hattori, McLeland & Naughton

[57] ABSTRACT

A doctor blade apparatus is attached to a doctor whose doctor blade is pressed against a metering roller provided in an inking train of a printing apparatus and scrapes off an excess portion of ink transferred onto the circumferential surface of the metering roller. The doctor blade apparatus comprises a blade holder attached to a base which moves toward and away from the metering roller, a doctor blade held by the blade holder and extending along substantially the entire axial length of the metering roller, and an elasticity-modifying member which abuts, along the longitudinal direction of the doctor blade, a deflection-side surface of the doctor blade whose edge is pressed against the circumferential surface of the metering roller and deflects accordingly. The elasticity-modifying member is movable toward and away from the edge of the doctor blade. A reciprocal movement mechanism reciprocally moves the elasticity-modifying member toward and away from the edge of the doctor blade. A plurality of elasticity-modifying members may be provided for a single doctor blade along the axial direction of the metering roller and may be adapted to be movable independently of each other.

18 Claims, 11 Drawing Sheets

DOCTOR BLADE APPARATUS

BACKGROUND OF THE INVENTION

1. Field of the Invention:

The present invention relates to a doctor blade apparatus in a keyless printing machine, and particularly to a doctor blade apparatus in a keyless inking arrangement capable of changing a total amount of ink supply as appropriate; for example, a doctor blade apparatus in a keyless inking arrangement which uses high-viscosity ink (so-called hard ink) used in an offset printing machine or low-viscosity ink (so-called soft ink).

2. Description of the Related Art:

Generally, inking arrangements of an ink-fountain type are known to use high-viscosity ink and are divided broadly into two categories, an ink-key type and a blade type.

In an inking arrangement of the ink-key type (not shown), an ink fountain is provided with a plurality of ink keys whose tips face the smooth circumferential surface of a fountain roller. The tips of the ink keys are each moved with respect to the circumferential surface of the fountain roller so as to maintain appropriate gaps therebetween. As the fountain roller rotates, ink adhering to the circumferential surface of the fountain roller is drawn out as appropriate through the gaps.

In an inking arrangement of the blade type (not shown), there is used a blade that is substantially as long as a fountain roller. In contrast to a rigid ink key, the blade has an elastic edge, which faces the smooth circumferential surface of the fountain roller. An appropriate gap is previously established between the blade edge and the fountain roller surface. A separately provided member is adapted to move the blade edge toward or away from the fountain roller surface to thereby adjust the gap as appropriate. As the fountain roller rotates, ink adhering to the circumferential surface of the fountain roller is drawn out as appropriate through the gap.

In these inking arrangements of the ink-fountain type, in principle, tips of the ink keys and the edge of the blade are not pressed against the circumferential surface of the fountain roller.

A conventional doctor blade apparatus in a keyless inking arrangement and ink used therewith are disclosed, for example, in "Newspaper Printing Handbook" (The Japan Newspaper Publishers and Editors Association, Apr. 10, 1997, pp. 67, 68, 178, 189). The doctor blade apparatus is adapted to supply ink such that an ink film formed newly on the circumferential surface of a form roller always becomes uniform irrespective of local variations in ink consumption derived from irregular distribution of printed image patterns.

According to the above publication, in the doctor blade apparatus, the edge of the doctor blade is pressed against a metering roller of resin having fine pits and projections formed on its surface, thereby scraping excess ink off the surface and thus forming a substantially uniform film of ink. The thus-formed uniform film of ink is transferred onto the form roller. Also, ink used with the keyless inking arrangement is generally low in viscosity as compared to ink used with inking arrangements of the ink-fountain type and of an ink-pump type employed in ordinary offset printing machines.

The doctor blade apparatus disclosed in the above publication is of the keyless inking arrangement that uses so-called keyless ink having low viscosity, generally a Laray viscosity of about 20 to 30 poise or about 35 to 50 poise. According to an inking sequence, an excessive amount of ink is transferred from an upstream roller onto the circumferential surface of the metering roller. The edge of the doctor blade pressed against the circumferential surface of the metering roller scrapes excess ink off the surface to thereby transfer ink onto the form roller in the form of a substantially uniform film. A surface portion of the metering roller is mainly made of a resin, for example, and has numerous fine pits and projections formed thereon so as to receive ink as appropriate.

Prior art for changing a total amount of ink supply through action of a doctor blade apparatus is disclosed in, for example, Japanese Patent Publication No. 6-75963.

In the doctor blade apparatus disclosed in the above publication, a base of a blade holder for holding a doctor blade is rotatable, and the position of the base is adjustable so as to adjust the distance between the doctor blade and the center of a metering roller. Through adjustment of the distance and the angle of the base, the state in which the edge of the doctor blade is pressed against the circumferential surface of the metering roller is adjusted within a range from a tangential state in which the edge follows rotation of the metering roller to a tangential state in which the edge counters the rotation. This arrangement enables use of inks of different viscosities.

The above doctor blade apparatus disclosed in "Newspaper Printing Handbook" (The Japan Newspaper Publishers and Editors Association, Apr. 10, 1997, pp. 67, 68, 178, 189) has a drawback in that adjusting the degree of scraping ink with the edge of the doctor blade or adjusting the thickness of a formed ink film is impossible. Accordingly, the density of image printed on paper (hereinafter, simply referred to as "printing density") varies depending on condition or wear of the edge of the doctor blade or condition of the circumferential surface of the metering roller, or varies with their time-course change.

The above problem, coupled with the following problems, impairs printing quality.

(1) Because of inevitable adverse factors, such as nonuniformity among manufactured metering rollers in material for a surface portion and in machined state of the surface, transfer of ink differs among metering rollers, resulting in nonuniform printing density.

(2) In the case of color printing, color inks differ in consumption in order to obtain a desired printing density, thus failing to achieve color balance.

(3) As printing speed varies, the amount of transfer of ink varies, causing variation in printing density.

(4) Operation-related variation in temperature causes ink viscosity to vary; thus, the amount of transfer of ink varies, causing variation in printing density.

The above inking arrangement disclosed in Japanese Patent Publication No. 6-75963 is not devised in terms of a doctor blade and a blade holder. Through adjustment of rotational angle of the base that carries the doctor blade and the blade holder and through position adjustment of the base, the angle and the force of pressing the edge of the doctor blade against the circumferential surface of a metering roller are varied. The correlation between the angle and the force of pressing the edge of the doctor blade against the circumferential surface of the metering roller is very difficult to obtain. In other words, in order to increase or decrease the pressing force for varying the degree of scraping ink with the edge, the doctor blade must be deflected to a relatively large extent, causing great variation in the pressing angle.

Similarly, when the pressing angle is increased or decreased, the pressing force varies to a relatively large extent. In other words, at an appropriate pressing angle, a pressing force appropriate for the angle is difficult to obtain. As a result, inking varies with a resultant failure to obtain stable printing density. Also, scraping high-viscosity ink induces a large resistance force, which may cause deformation of the doctor blade. Thus, defective printing is likely to occur.

SUMMARY OF THE INVENTION

An object of the present invention is to concurrently solve the above-described various problems and to provide a doctor blade apparatus which can provide an appropriate printing density through solution of the problem that the state of scraping ink off the circumferential surface of a metering roller with the edge of a doctor blade changes depending on the viscosity of ink, the type of ink, the temperature of ink, and printing speed, and as well depending on wear of the edge of the doctor blade and the state of the circumferential surface of the metering roller.

A doctor blade apparatus of the present invention is attached to a doctor whose doctor blade is pressed against a metering roller provided in an inking train of a printing apparatus and scrapes off an excess portion of ink transferred onto the circumferential surface of the metering roller.

The doctor blade apparatus comprises a blade holder attached to a base which moves toward and away from a metering roller; a doctor blade held by the blade holder and extending along substantially the entire axial length of the metering roller; an elasticity-modifying member abutting, along the longitudinal direction of the doctor blade, a deflection-side surface of the doctor blade whose edge is pressed against the circumferential surface of the metering roller and deflects accordingly, and which is capable of being reciprocally moved toward and away from the edge of the doctor blade; and reciprocal movement means for reciprocally moving the elasticity-modifying member toward and away from the edge of the doctor blade.

The elasticity-modifying member is not necessarily of a single unit, but may assume the form of a plurality of elasticity-modifying members abutting, along the longitudinal direction of the doctor blade, a deflection-side surface of the doctor blade which extends along substantially the entire axial length of the metering roller and whose edge is pressed against the circumferential surface of the metering roller and deflects accordingly. The elasticity-modifying members can be reciprocally moved toward and away from the edge of the doctor blade independently of each other. The present invention also provides a doctor blade apparatus comprising such a plurality of elasticity-modifying members and reciprocal movement means for reciprocally moving the elasticity-modifying members independently of each other.

The above two types of doctor blade apparatuses further include the following variations:

1. The elasticity-modifying member is in the form of a plate held, together with the doctor blade, by the blade holder and restrictedly guided for reciprocal movement toward and away from the edge of the doctor blade. The reciprocal movement means is reciprocally driving means provided on the blade holder and directly linked to the elasticity-modifying member.

2. The elasticity-modifying member is in the form of a plate held, together with the doctor blade, by the blade holder and restrictedly guided for reciprocal movement toward and away from the edge of the doctor blade. The reciprocal movement means comprises a reciprocally moving member whose tip is linked to the elasticity-modifying member and which can move reciprocally toward and away from the edge of the doctor blade, and reciprocally driving means for reciprocally driving the reciprocally moving member toward and away from the edge of the doctor blade.

3. The elasticity-modifying member is of a narrow form extending in the longitudinal direction of the doctor blade and abuts merely a projected edge portion of the doctor blade held by the blade holder. The reciprocal movement means comprises a reciprocally moving member whose tip is linked to the elasticity-modifying member and which can move reciprocally toward and away from the edge of the doctor blade, and reciprocally driving means for reciprocally driving the reciprocally moving member toward and away from the edge of the doctor blade.

Examples of the reciprocally driving means include a cam mechanism, a screw mechanism, a piezoelectric actuator, and an ultrasonic linear motor.

The present invention can provide an appropriate printing density through solution of the problem that the state of scraping ink off the circumferential surface of a metering roller with the edge of a doctor blade changes depending on the viscosity of ink, the type of ink, the temperature of ink, and printing speed, and as well depending on wear of the edge of the doctor blade and the state of the circumferential surface of the metering roller.

Specifically, the present invention yields the following effects.

(1) Through rotation effected by, for example, hydraulic cylinders, the elasticity-modifying member disposed in contact with the doctor blade is reciprocally moved so as to appropriately modify the elastic force of the edge of the doctor blade pressed against the circumferential surface of the metering roller.

(2) Through the above modification of the elastic force of the edge of the doctor blade, there can be solved a drawback involved in a conventional keyless printing machine that printing density cannot be varied as desired, i.e., printing density can be appropriately modified.

(3) Through division of the elasticity-modifying means, for example, on page basis, printing density can be adjusted on page basis (this feature is most difficult for a conventional keyless printing machine to achieve), and can be concurrently adjusted over the entire length of a plate cylinder.

(4) Through the above adjustment of printing density, printing quality of, for example, newspaper is improved, and a burden on a worker engaged in quality control is lessened.

DESCRIPTION OF THE PREFERRED EMBODIMENTS

Embodiments of the present invention will next be described with reference to the drawings.

Figure 1:
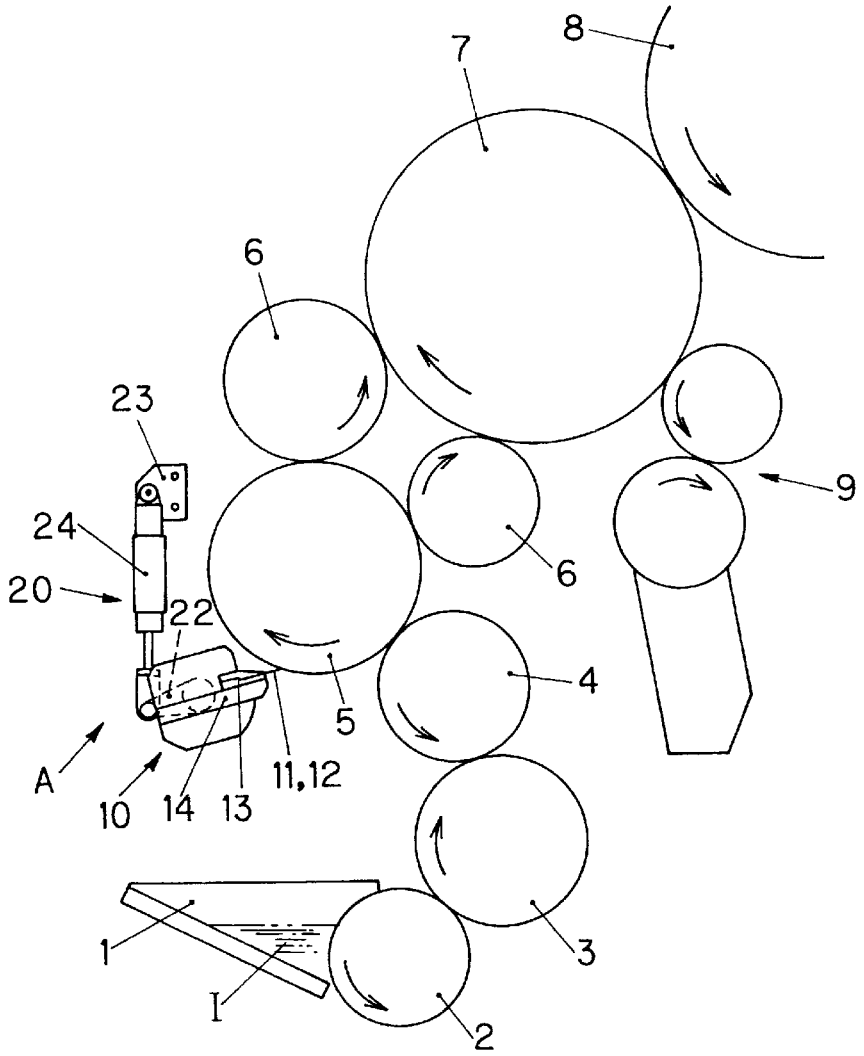
FIG. 1 is a schematic diagram showing a keyless inking arrangement of a printing apparatus to which a doctor blade apparatus according to the present invention is applied.

A doctor blade apparatus according to each embodiment of the present invention is applied to a keyless inking arrangement of a printing apparatus capable of using ink having relatively high viscosity as shown in FIG. 1.

In the keyless inking arrangement of the printing apparatus, there are arranged from upstream to downstream of an inking train a fountain roller 2 adjacent to which an ink fountain 1 is provided, a transfer roller 3, an intermediate roller 4, a metering roller 5 having fine pits and projections on the circumferential surface thereof, form rollers 6, a plate cylinder 7 onto which is mounted a printing plate, and a blanket cylinder 8 onto which is mounted a blanket such that the circumferential surfaces of the respective rollers and cylinders are sequentially brought in the vicinity of each other or in contact with each other. The metering roller 5 is provided with a doctor A for scraping off an excess portion of ink transferred onto the circumferential surface thereof. The plate cylinder 7 is provided with a dampening arrangement 9.

Figure 3:
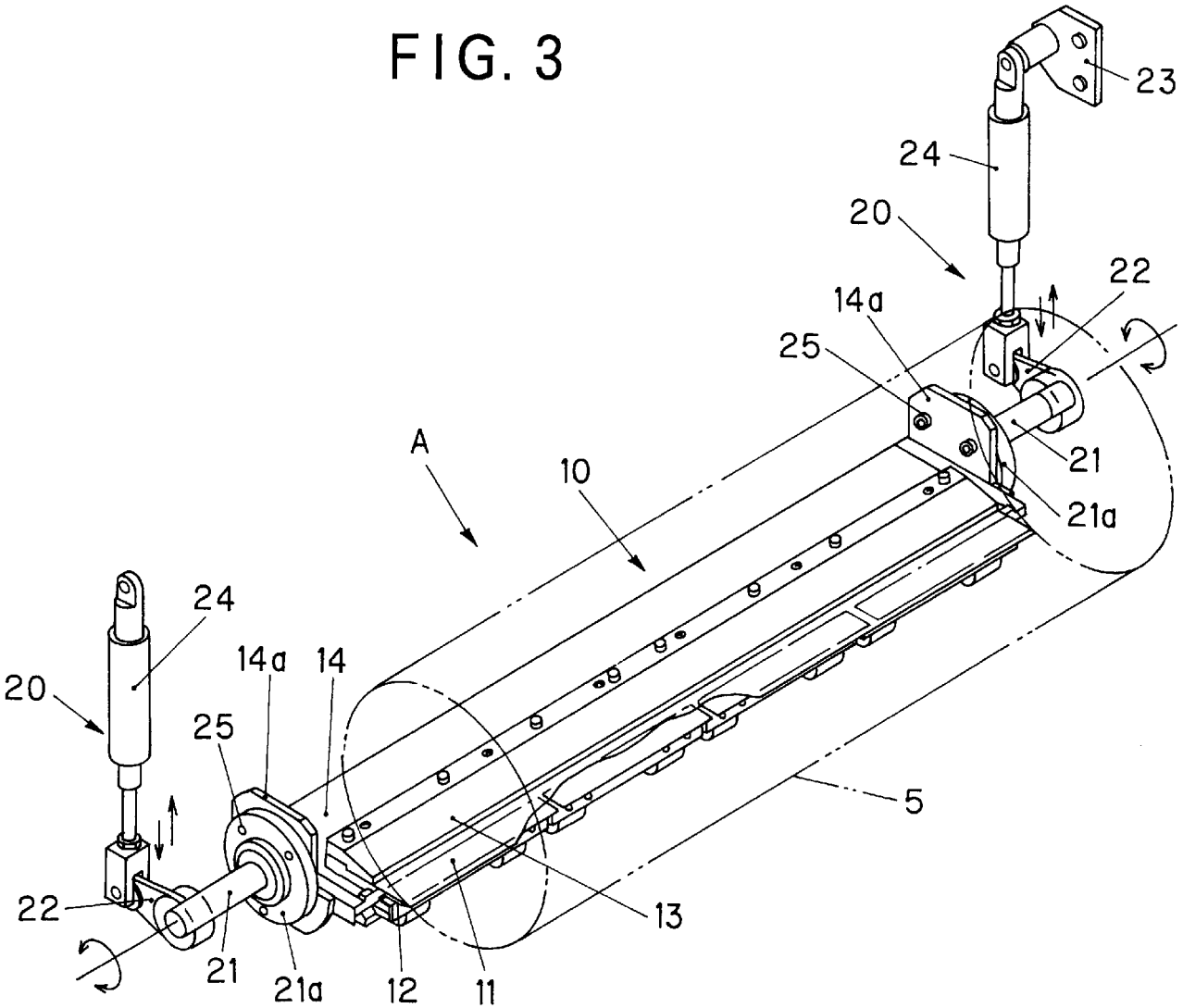
FIG. 3 is a perspective view showing the entire doctor blade apparatus according to the present invention.

As shown in FIG. 3, the doctor A is composed of a doctor blade apparatus 10 and a doctor blade apparatus driving mechanism 20. The doctor blade apparatus 10 includes a doctor blade 11, an elasticity-modifying member 12 abutting and supporting the doctor blade 11, a blade holder 13 for holding the doctor blade 11 and the elasticity-modifying member 12, a base 14 onto which the blade holder 13 is mounted, and reciprocal movement means for reciprocally moving the elasticity-modifying member 12. The doctor blade apparatus driving mechanism 20 includes support shafts 21 which are rotatably supported by opposite frames (not shown) via corresponding bearings, arms 22, each of which is attached at one end to each support shaft 21, and hydraulic cylinders 24. In each of the hydraulic cylinders 24, the tip of a piston rod is connected to the other end of the corresponding arm 22, and a mounting end portion of a cylinder body is pin-connected to a bracket 23 which is fixedly attached to the frame (not shown).

In the doctor blade apparatus 10, the base 14 is a rectangular thick plate which is sufficiently long to carry the doctor blade 11, which is substantially as long as the metering roller 5, i.e., sufficiently long to carry the blade holder 13. Flanges 14*a* are formed upright at opposite end portions of the base 14. Each flange 14*a* is coupled through use of bolts 25 with a flange 21*a* formed at an inner end of the corresponding support shaft 21, which is rotatably supported by the frame (not shown) via the bearing.

In the doctor A, the piston rods are hydraulically projected from or retracted into the corresponding hydraulic cylinders 24 so as to rotate the base 14 of the doctor blade apparatus 10 by a predetermined angle about the axis of the support shafts 21 via the arms 22. As a result, the edge of the doctor blade 11 of the doctor blade apparatus 10 is pressed against or moved away from the circumferential surface of the metering roller 5. The thrust of the piston rod of each hydraulic cylinder 24 is regulated by unillustrated hydraulic-pressure regulating means so as to be always greater than an elastic force generated at the edge of the doctor blade 11 pressed against the circumferential surface of the metering roller 5.

The above keyless inking arrangement of the printing apparatus permits use of ink having relatively high viscosity. Ink I contained in the ink fountain 1 is drawn out by the rotating fountain roller 2 and is then transferred onto the circumferential surface of the metering roller 5 having fine pits and projections formed thereon, via the rotating ink transfer roller 3 and the rotating intermediate roller 4.

Figure 2A:
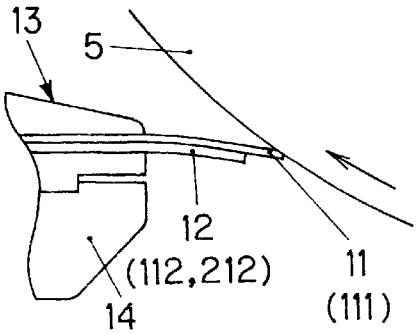
FIGS. 2A and 2B are view each showing the state of pressing against a metering roller a doctor blade of the doctor blade apparatus according to the present invention.
Figure 2B:
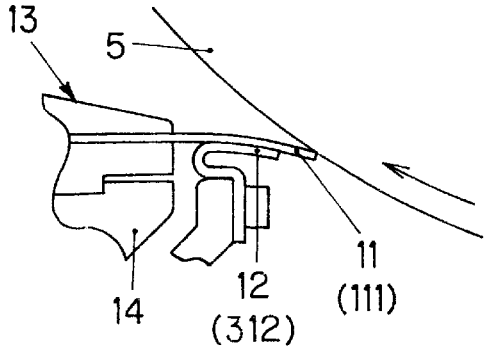

In the doctor A, when the piston rods are hydraulically projected from the respective hydraulic cylinders 24, the arms 22 rotate counterclockwise in FIG. 1 by a predetermined angle about the respective support shafts 21. Accordingly, the support shafts 21, i.e., the base 14 of the doctor blade apparatus 10, rotates counterclockwise in FIG. 1 by the predetermined angle. As a result, as shown in FIGS. 2A and 2B, the edge of the doctor blade 11 held by the blade holder 13 mounted on the base 14 is pressed against the circumferential surface of the metering roller 5 which is rotating clockwise, and is thus deflected downward together with the elasticity-modifying element 12 abutting the lower side thereof.

An excess portion of the ink I transferred onto the circumferential surface of the metering roller 5 is scraped off by the doctor blade 11, leaving a predetermined amount of the ink I on the metering roller 5. Then, the ink I is sequentially transferred onto the form rollers 6, a printing plate attached to the plate cylinder 7, and a blanket attached to the blanket cylinder 8, thereby performing printing at a predetermined density.

In the doctor blade apparatus 10, the position of the tip edge of the elasticity-modifying member 12 with respect to the edge of the doctor blade 11 determines the elastic force of the doctor blade 11, which is pressed against the metering roller 5, and thus determines the amount of ink to be scraped off by the doctor blade 11.

In order to adjust the elastic force generated at the edge of the doctor blade 11, or the amount of ink to be scraped off, the reciprocal movement means of the doctor blade apparatus moves the elasticity-modifying member 12 toward or away from the edge of the doctor blade 11 to thereby adjust the position of the tip edge of the elasticity-modifying member 12 with respect to the edge of the doctor blade 11, which will be described later in detail.

FIG. 2A shows the elasticity-modifying member 12 (112 or 212) in a doctor blade apparatus according to a first or second embodiment of the present invention. FIG. 2B shows the elasticity-modifying member 12 (312) in a doctor blade apparatus according to any of third through sixth embodiments of the present invention.

First, the doctor blade apparatus according to the first embodiment will be described.

Figure 4:
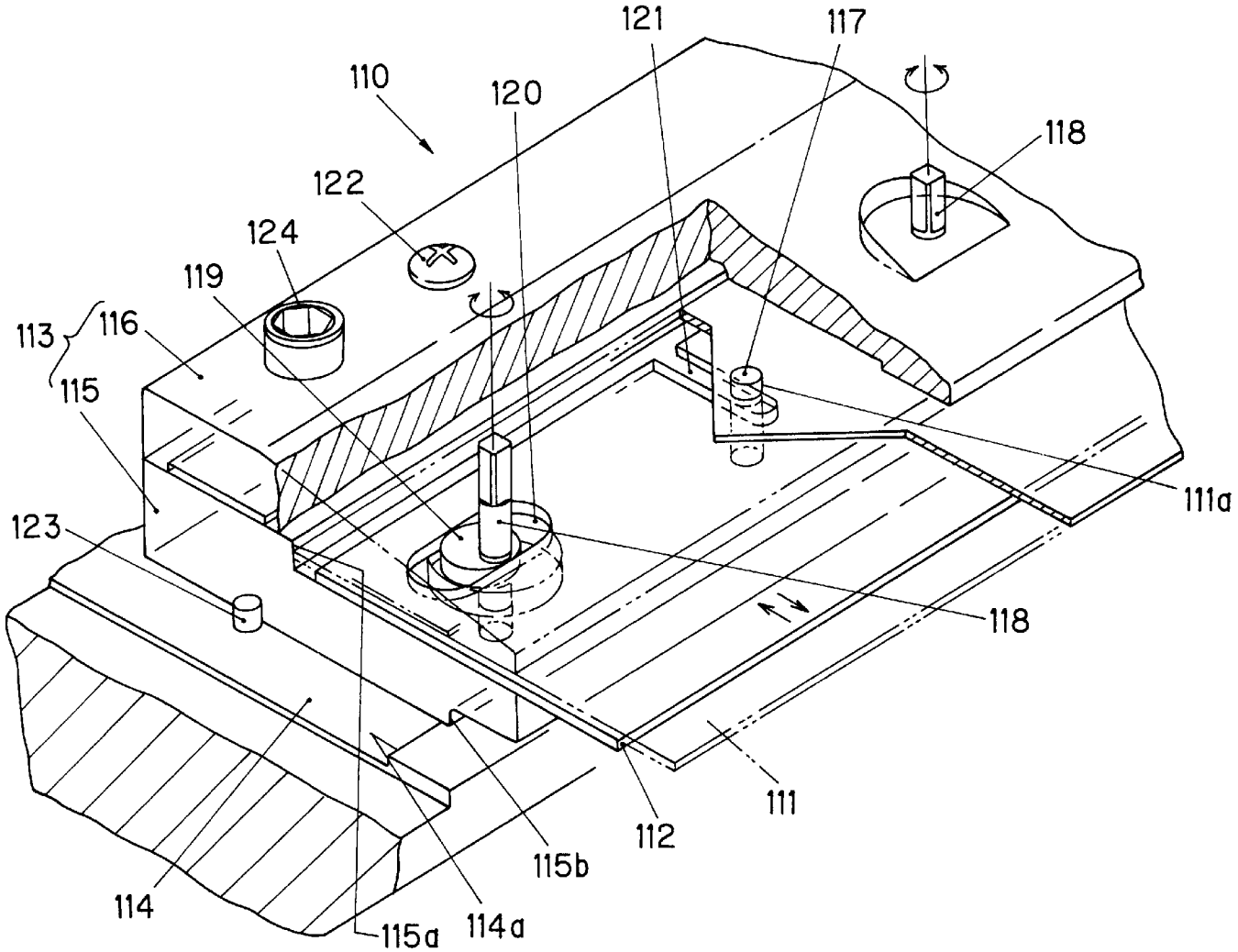
FIG. 4 is a partial perspective view of a doctor blade apparatus according to a first embodiment of the present invention.
Figure 5:
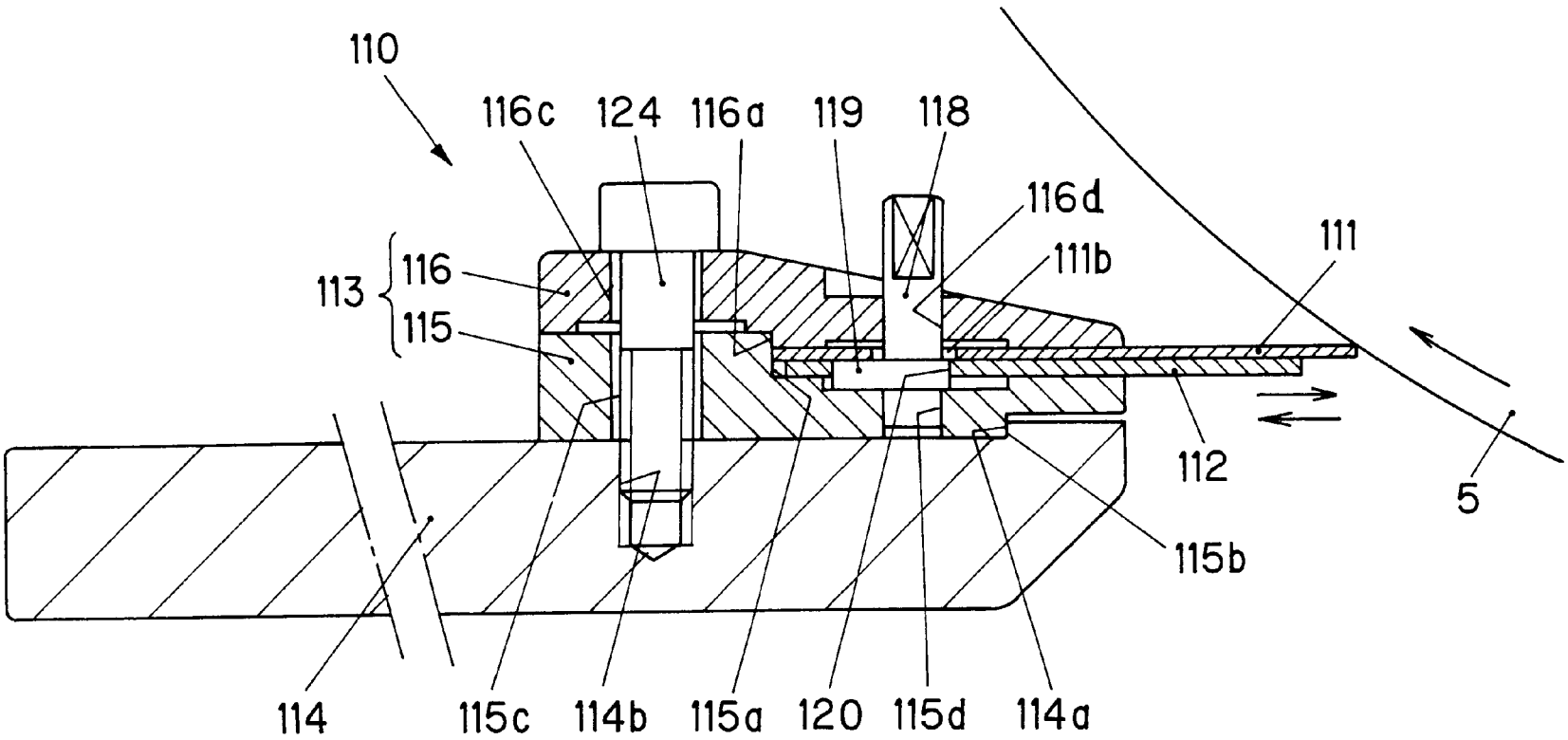
FIG. 5 is a sectional view of the doctor blade apparatus according to the first embodiment.

As shown in FIGS. 4 and 5, a doctor blade apparatus 110 includes a doctor blade 111, an elasticity-modifying member 112 which supports the doctor blade 111, a blade holder 113 for holding the doctor blade 111 and the elasticity-modifying member 112, a base 114 onto which the blade holder 113 is mounted, and reciprocal movement means for reciprocally moving the elasticity-modifying member 112.

The blade holder 113 includes a rest 115 and a holder plate 116, which are adapted to hold therebetween the elasticity-modifying member 112 and the doctor blade 111 having a length substantially identical to that of the metering roller 5 and each substantially as long as the doctor blade 111.

The rest 115 assumes the form of a thick. A stepped portion 115*a* extending in the axial direction of the metering roller 5 is formed on the upper surface of the rest 115 such that the rear (left-hand in FIG. 5) region of the upper surface having a width about ⅓ that of the upper surface is higher than the front (right-hand in FIG. 5) remaining region. The lower surface of the rest 115, which is placed on the upper surface of the base 114, has a stepped portion 115*b* formed in a front region thereof. The stepped portion 115*b* abuts a front positioning portion 114*a* of the base 114 which assumes a stepped form projecting upward from a front region of the upper surface of the base 114 and extending in the axial direction of the metering roller 5.

The holder plate 116 assumes the form of a thick plate having a width substantially identical to that of the upper surface of the rest 115. In the holder plate 116, the rear (left-hand in FIG. 5) region of the upper surface having a width about ⅓ that of the upper surface is planar, whereas the front (right-hand in FIG. 5) remaining region slopes downward. A stepped portion 116*a* is formed on the lower surface of the holder plate 116 and abuts the stepped portion 115*a* formed on the upper surface of the rest 115 so that the lower surface of the holder plate 116 rests on the upper surface of the rest 115.

The elasticity-modifying member 112 in the form of a plate is placed on a front region of the upper surface of the rest 115. The doctor blade 111 is placed on the elasticity-modifying member 112 with its rear end abutting the stepped portion 115*a* of the rest 115. The holder plate 116 is placed on the doctor blade 111 with its stepped portion 116*a* abutting the stepped portion 115*a* of the rest 115.

In the rest 115 and the holder plate 116, which are superposed on each other, an appropriate number of bolt holes are arranged in a rear region of the holder plate 116 at certain intervals and in the axial direction of the metering roller 5, and threaded holes open in a rear region of the upper surface of the rest 115 and are arranged at positions corresponding to the bolt holes. Assembly bolts 122 are inserted into the respective bolt holes and are tightened into the respective threaded holes to thereby assemble the rest 115 and the holder plate 116 into a single unit; thus, the doctor blade 111 and the elasticity-modifying member 112 which are superposed on each other are held in a gap formed between front regions of the rest 115 and the holder plate 116.

The rear end of the doctor blade 111 abuts the stepped portion 115*a* of the rest 115, whereas the elasticity-modifying member 112 can advance and retreat against friction with the doctor blade 111 and that with the rest 115.

Positioning pins 117 stand upright in a front region of the upper surface of the rest 115 and are arranged at certain intervals in the axial direction of the metering roller 5. A plurality of slots 121 are formed in the elasticity-modifying member 112 in such a manner as to extend in the front-rear direction, open at the rear end of the elasticity-modifying member 112, and are arranged at positions corresponding to the positioning pins 117. A plurality of positioning holes 111*a* are arranged in the doctor blade 111 at positions corresponding to the positioning pins 117. The positioning pins 117 are fitted into the corresponding slots 121 formed in the elasticity-modifying member 112 and into the corresponding positioning holes 111*a* formed in the doctor blade 111.

The reciprocal movement means for reciprocally moving the elasticity-modifying member 112 is configured in the following manner.

An elliptic guide hole 120 is formed in the elasticity-modifying member 112 and has a minor axis oriented in the front-rear direction and a major axis oriented in the axial direction of the metering roller 5. An eccentric disc cam 119 is formed at an intermediate portion of a cam shaft 118 and is fitted into the guide hole 120. In the rest 115 and the holder plate 116, which are superposed on each other, cam shaft holes 115*d* and 116*d* vertically extend through the respective front regions. Upper and lower end portions of the cam shaft 118 are rotatably inserted into the cam shaft holes 116*d* and 115*d*, respectively.

The upper portion of the cam shaft 118 extends through a hole 111*b* formed in the doctor blade 111 and through the cam shaft hole 116*d* formed in the holder plate 116 and projects upward beyond the upper surface of the holder plate 116. The projecting end portion of the cam shaft 118 assumes a prismatic form for engagement with a rotating tool to thereby serve as an operation end.

A plurality of guide holes 120 formed in the elasticity-modifying member 112 and a plurality of cam shaft holes 115*d* formed in the rest 115 are arranged in a mutually corresponding manner, while a plurality of slots 121 formed in the elasticity-modifying member 112 and a plurality of positioning pins 117 standing on the rest 115 are arranged in a mutually corresponding manner. Also, a plurality of cam shafts 118, each having the integrally formed eccentric disc cam 119, are provided accordingly.

In the elasticity-modifying member 112, the guide holes 120 and the slots 121 are alternately arranged in the axial direction of the metering roller 5.

In the case where the doctor blade 111 extends substantially along the entire axial length of the metering roller 5, and the elasticity-modifying member 112 is of a split type in which a plurality of elasticity-modifying members 112 are provided along the longitudinal direction of the doctor blade 111, at least a pair comprising the cam shaft hole 115*d* and the positioning pin 117 must be assigned to each elasticity-modifying member 112 so that the elasticity-modifying members 112 can be reciprocally moved independently of each other.

The thus-assembled doctor blade apparatus 110 is positioned through abutting of the stepped portion 115*b* formed on the lower surface of the rest 115 and the front positioning portion 114*a* of the base 114 and through abutting of the opposite sides of the rest 115 and positioning pins 123 projecting from the upper surface of the base 114. An assembly of the rest 115 and the holder plate 116 is fixedly attached onto the base 114 by insertion of mounting bolts 124 through bolt holes 115*c* and 116*c* formed in the rest 115 and the holder plate 116, respectively, and by tightening of the mounting bolts 124 into threaded holes 114*b* formed in the base 114. The bolt holes 115*c* and 116*c* vertically extend through the rest 115 and the holder plate 116, respectively, and are arranged in the rear regions of the rest 115 and the holder plate 116, respectively, at certain intervals and along the axial direction of the metering roller 5. The threaded holes 114*b* are arranged in a central region of the upper surface of the base 114 at certain intervals and along the axial direction of the metering roller 5.

In the above doctor blade apparatus 110, the top end, i.e., the working end of each cam shaft 118, is rotated for adjustment through use of an appropriate tool to thereby rotate the corresponding eccentric disc cam 119 within the corresponding guide hole 120 formed in the elasticity-modifying member 112. As a result, while the slot 121 is guided by the positioning pin 117, the elasticity-modifying member 112 is advanced or retreated along the lower side of the doctor blade 111. Thus, the position of the tip edge of the elasticity-modifying member 112 is adjusted in the front-rear direction and with respect to the edge of the doctor blade 111. In this connection, as shown in FIG. 2A, the edge of the doctor blade 111 is pressed against the circumferential surface of the rotating metering roller 5 and is deflected accordingly; and the tip edge of the elasticity-modifying member 112 supports the deflection side of the doctor blade 111.

In this case, the doctor blade 111 which is pressed at its edge abuts at its rear end the stepped portion 115*a* of the rest 115, and is thus positionally fixed. The elasticity-modifying member 112 is pressed by the downwardly deflecting doctor blade 111 and is thus positionally fixed.

Thus is adjusted the elastic force of the doctor blade 111, i.e., a force at which the edge of the doctor blade 111 is pressed against the circumferential surface of the metering roller 5.

A doctor blade apparatus according to a second embodiment of the present invention will next be described.

A base is similar to the base 114 (with respect to front positioning portion 114*a*, threaded holes 114*b*, positioning pins 123) of the above-described first embodiment. A doctor blade is also similar to that of the first embodiment.

Figure 6:
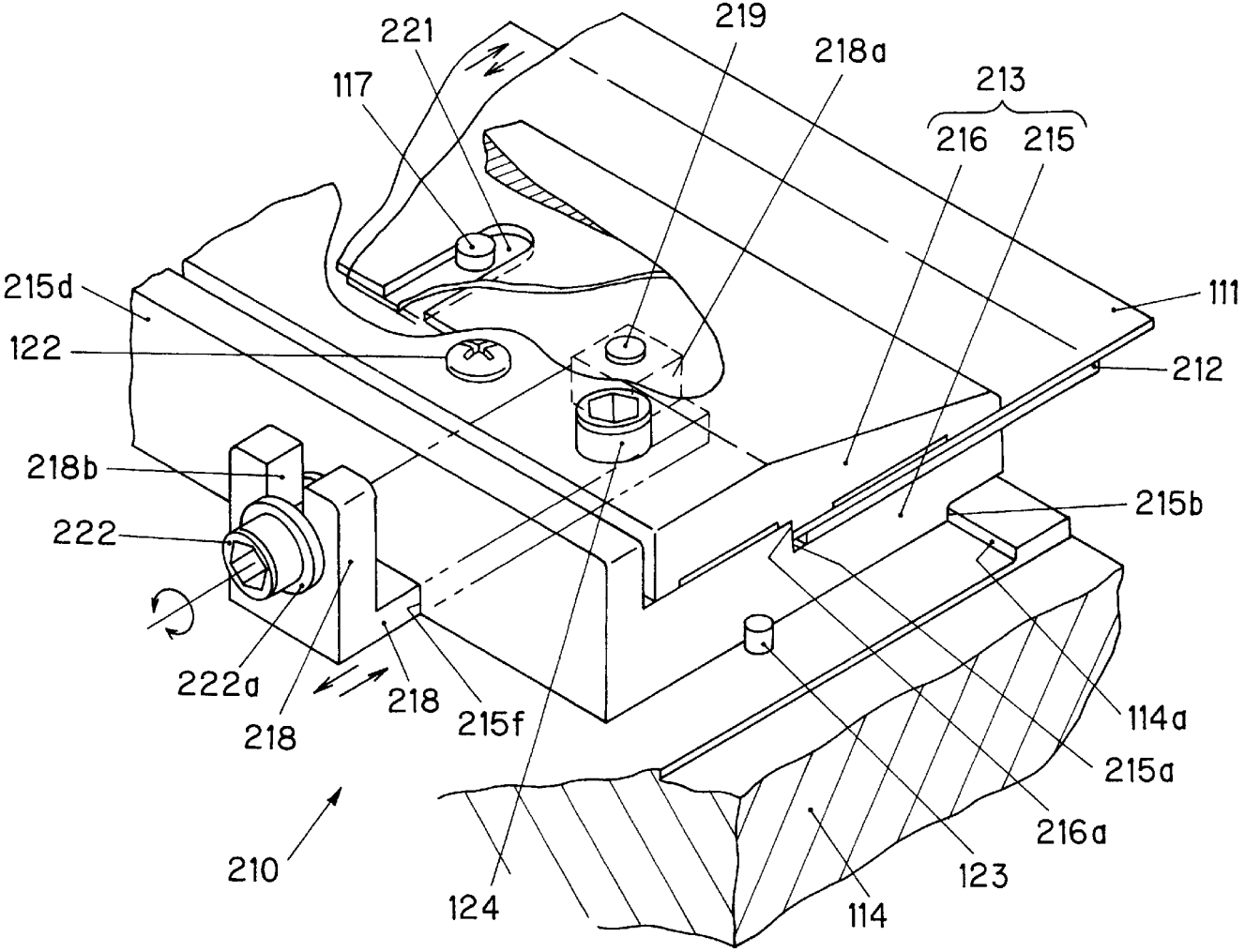
FIG. 6 is a partial perspective view of a doctor blade apparatus according to a second embodiment of the present invention.
Figure 7:
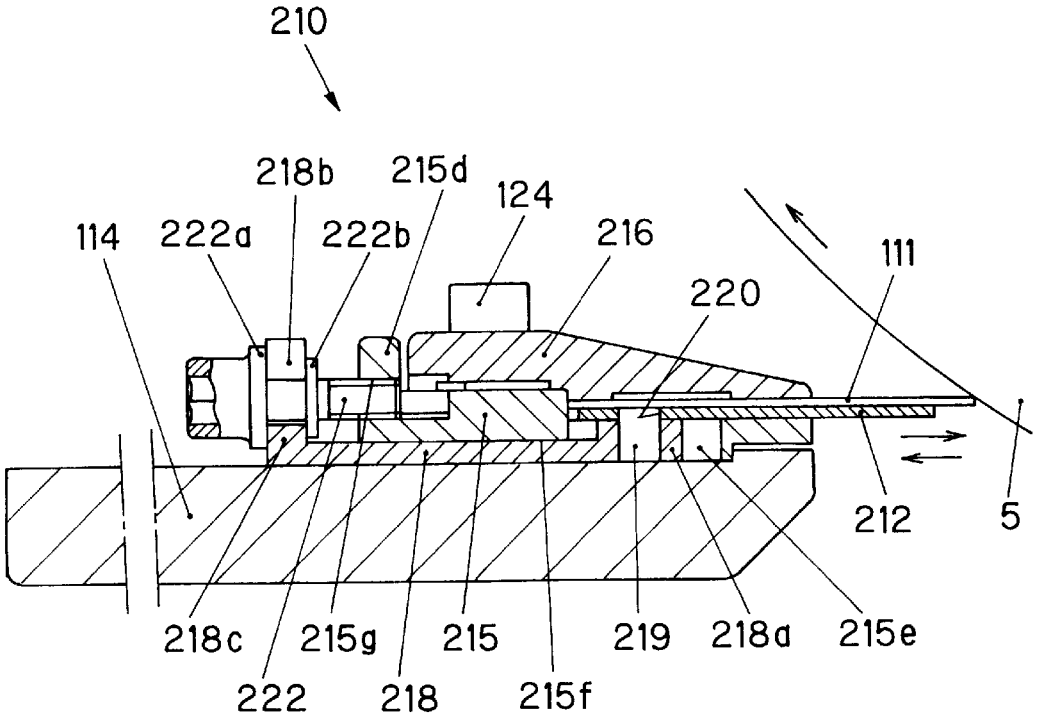
FIG. 7 is a sectional view of the doctor blade apparatus according to the second embodiment.
Figure 8:
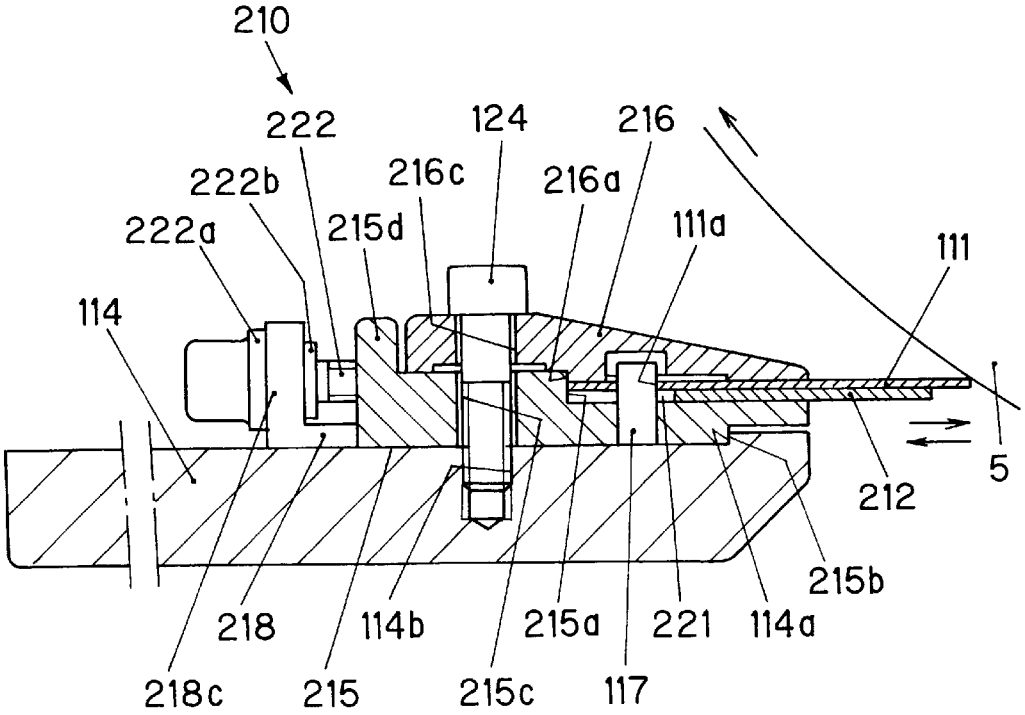
FIG. 8 is a sectional view of the doctor blade apparatus according to the second embodiment.

As shown in FIGS. 6, 7, and 8, a doctor blade apparatus 210 includes a doctor blade 111, an elasticity-modifying member 212 which supports the doctor blade 111, a blade holder 213 for holding the doctor blade 111 and the elasticity-modifying member 212, a base 114 onto which the blade holder 213 is mounted, and reciprocal movement means for reciprocally moving the elasticity-modifying member 212.

The blade holder 213 includes a rest 215 and a holder plate 216, which are adapted to hold therebetween the elasticity-modifying member 212 and the doctor blade 111 having a length substantially identical to that of the metering roller 5 and which are substantially as long as the doctor blade 111.

The rest 215 assumes the form of a thick plate. A stepped portion 215*a* extending in the axial direction of the metering roller 5 is formed on the upper surface of the rest 215 such that the rear (left-hand in FIG. 7) region of the upper surface having a width about ⅓ that of the upper surface is higher than the front (right-hand in FIG. 7) remaining region. The lower surface of the rest 215, which is placed on the upper surface of the base 114, has a stepped portion 215*b* formed in a front region thereof. The stepped portion 215*b* abuts a front positioning portion 114*a* of the base 114 which assumes a stepped form projecting upward from a front region of the upper surface of the base 114 and extending in the axial direction of the metering roller 5.

The holder plate 216 assumes the form of a thick plate whose face matches the upper surface of the rest 215. In the holder plate 216, the rear (left-hand in FIG. 7) region of the upper surface having a width about ⅓ that of the upper surface is planar, whereas the front (right-hand in FIG. 7) remaining region slopes downward. A stepped portion 216*a* is formed on the lower surface of the holder plate 216 and abuts the stepped portion 215*a* formed on the upper surface of the rest 215 so that the lower surface of the holder plate 216 rests on the upper surface of the rest 215.

The elasticity-modifying member 212 in the form of a plate is placed on a front region of the upper surface of the rest 215. The doctor blade 111 is placed on the elasticity-modifying member 212 with its rear end abutting the stepped portion 215*a* of the rest 215. The holder plate 216 is placed on the doctor blade 111 with its stepped portion 216*a* abutting the stepped portion 215*a* of the rest 215.

In the rest 215 and the holder plate 216, which are superposed on each other, an appropriate number of bolt holes are arranged in a rear region of the holder plate 216 at certain intervals and in the axial direction of the metering roller 5, and threaded holes opens in a rear region of the upper surface of the rest 215 and are arranged at positions corresponding to the bolt holes. Assembly bolts 122 are inserted into the respective bolt holes and are tightened into the respective threaded holes to thereby assemble the rest 215 and the holder plate 216 into a single unit; thus, the doctor blade 111 and the elasticity-modifying member 212, which are superposed on each other, are held in a gap formed between front regions of the rest 215 and the holder plate 216.

The rear end of the doctor blade 111 abuts the stepped portion 215*a* of the rest 215, whereas the elasticity-modifying member 212 can advance and retreat against friction with the doctor blade 111 and that with the rest 215.

Positioning pins 117 stand upright in a front region of the upper surface of the rest 215 and are arranged at certain intervals in the axial direction of the metering roller 5. A plurality of slots 221 are formed in the elasticity-modifying member 212 in such a manner as to extend in the front-rear direction, open at the rear end of the elasticity-modifying member 212, and are arranged at positions corresponding to the positioning pins 117. A plurality of positioning holes llla are arranged in the doctor blade 111 at positions corresponding to the positioning pins 117. The positioning pins 117 are fitted into the corresponding slots 221 formed in the elasticity-modifying member 112 and into the corresponding positioning holes 111*a* formed in the doctor blade 111.

The reciprocal movement means for reciprocally moving the elasticity-modifying member 212 is configured in the following manner.

A flange 215*d* is formed upright at the rear end of the rest 215. A rectangular space 215*e* is formed in a front region of the rest 215 in such a manner as to be adjacent to the stepped portion 215*a* and to extend vertically through the rest 215 so as to open at the upper and lower surfaces of the rest 215. A guide groove 215*f* having a rectangular section is formed in the lower surface of the rest 215 and extends from the rear end surface of the rest 215 to the space 215*e*.

The spaces 215*e* and the guide grooves 215*f* are arranged at appropriate intervals in the axial direction of the metering roller 5. For example, at least a pair comprising the space 215*e* and the guide groove 215*f* may be provided at each of opposite side portions of the rest 215.

A reciprocally moving member 218 is fitted into the guide groove 215*f* (as will be described later, when the rest 215 is placed on the base 114, the guide groove 215*f* and the upper surface of the base 114 defines a guide hole having a rectangular section) slidably and with an appropriate friction. A first projection 218*a* projects upward from a front end portion of the reciprocally moving member 218 in the space 215*e* and is as high as up to the height of the upper surface of a front region of the rest 215. A coupling pin 219 projects upward from the upper surface of the first projection 218*a* to a height of up to the upper surface of the elasticity-modifying member 212 placed on the rest 215. The coupling pin 219 is fitted into a coupling hole 220 formed in the elasticity-modifying member 212.

From a rear end portion of the reciprocally moving member 218 which projects rearward beyond the flange 215*d*, a second projection 218*c* is projected such that it is opposed to the flange 215*d* of the rest 215. A letter-U-shaped groove 218*b* is formed in the second projection 218*c*. A portion of a flanged bolt 222 extending between flanges 222*a* and 222*b* is fitted into the letter-U-shaped groove 218*b*. The flanged bolt 222 is in screw-engagement with a threaded hole 215*g* formed in the flange 215*d* of the rest 215. A head portion of the flanged bolt 222 is adapted to engage a rotating tool so as to serve as an operation end.

A plurality of guide holes, i.e., a plurality of reciprocally moving members 218 fitted into the guide holes, are arranged at certain intervals in the axial direction of the metering roller 5. A plurality of coupling holes 220 formed in the elasticity-modifying member 212 and a plurality of coupling pins 219 associated with the rest 215 are arranged in the axial direction of the metering roller 5 in such a manner as to correspond to each other. In the elasticity-modifying member 212, the slots 221 and the coupling holes 220 are arranged alternately. The guide groove 215*f* formed in the rest 215 differs from a bolt hole 215*c* (which will appear later) in position along the axial direction of the metering roller 5.

In the case where the doctor blade 111 extends substantially along the entire axial length of the metering roller 5, and the elasticity-modifying member 212 is of a split type in which a plurality of elasticity-modifying members 212 are provided along the longitudinal direction of the doctor blade 111, at least a pair comprising the reciprocally moving member 218 and the positioning pin 117 must be assigned to each elasticity-modifying member 212 so that the elasticity-modifying members 212 can be reciprocally moved independently of each other.

The thus-assembled doctor blade apparatus 210 is positioned through abutting of the stepped portion 215*b* formed on the lower surface of the rest 215 and the front positioning portion 114*a* of the base 114 and through abutting of the opposite sides of the rest 215 and the positioning pins 123 projecting from the upper surface of the base 114. An assembly of the rest 215 and the holder plate 216 is fixedly attached onto the base 114 by insertion of mounting bolts 124 through bolt holes 215*c* and 216*c* formed in the rest 215 and the holder plate 216, respectively, and by tightening of the mounting bolts 124 into threaded holes 114*b* formed in the base 114. The bolt holes 215*c* and 216*c* vertically extend through the rest 215 and the holder plate 216, respectively, and are arranged in the rear regions of the rest 215 and the holder plate 216, respectively, at certain intervals and along the axial direction of the metering roller 5. The threaded holes 114*b* are arranged in a central region of the upper surface of the base 114 at certain intervals and along the axial direction of the metering roller 5.

In the above doctor blade apparatus 210, the head portion, i.e., the working end of each flanged bolt 222, is rotated for adjustment through use of an appropriate tool to thereby advance or retreat the flanged bolt 222 with respect to the rest 215. Since the second projection 218*c* of the reciprocally moving member 218 is held between the flanges 222*a* and 222*b* of the flanged bolt 222, the reciprocally moving member 218 advances or retreats along the guide groove 215*f* formed in the rest 215.

The coupling pin 219 of the first projection 218*a* of the reciprocally moving member 218 is fitted into the coupling hole 220 formed in the elasticity-modifying member 212, so that the reciprocally moving member 218 and the elasticity-modifying member 212 are united. As a result, while the slot 221 is guided by the positioning pin 117, the elasticity-modifying member 212 is advanced or retreated along the lower side of the doctor blade 111. Thus, the position of the tip edge of the elasticity-modifying member 212 is adjusted in the front-rear direction and with respect to the edge of the doctor blade 111. In this connection, as shown in FIG. 2A, the edge of the doctor blade 111 is pressed against the circumferential surface of the rotating metering roller 5 and is deflected accordingly; and the tip edge of the elasticity-modifying member 212 supports the deflection side of the doctor blade 111.

In this case, the doctor blade 111 which is pressed at its edge abuts at its rear end the stepped portion 215*a* of the rest 215, and is thus positionally fixed. The elasticity-modifying member 212 is pressed by the downwardly deflecting doctor blade 111 and is thus positionally fixed.

Thus is adjusted the elastic force of the doctor blade 111, i.e., a force at which the edge of the doctor blade 111 is pressed against the circumferential surface of the metering roller 5.

A doctor blade apparatus according to a third embodiment of the present invention will next be described.

A base and a doctor blade are similar to the base 114 (with respect to front positioning portion 114*a*, threaded holes 114*b*, positioning pins 123) and the doctor blade 111 of the above-described first embodiment except that a through-hole 320 (which will be described later) is formed.

Figure 9:
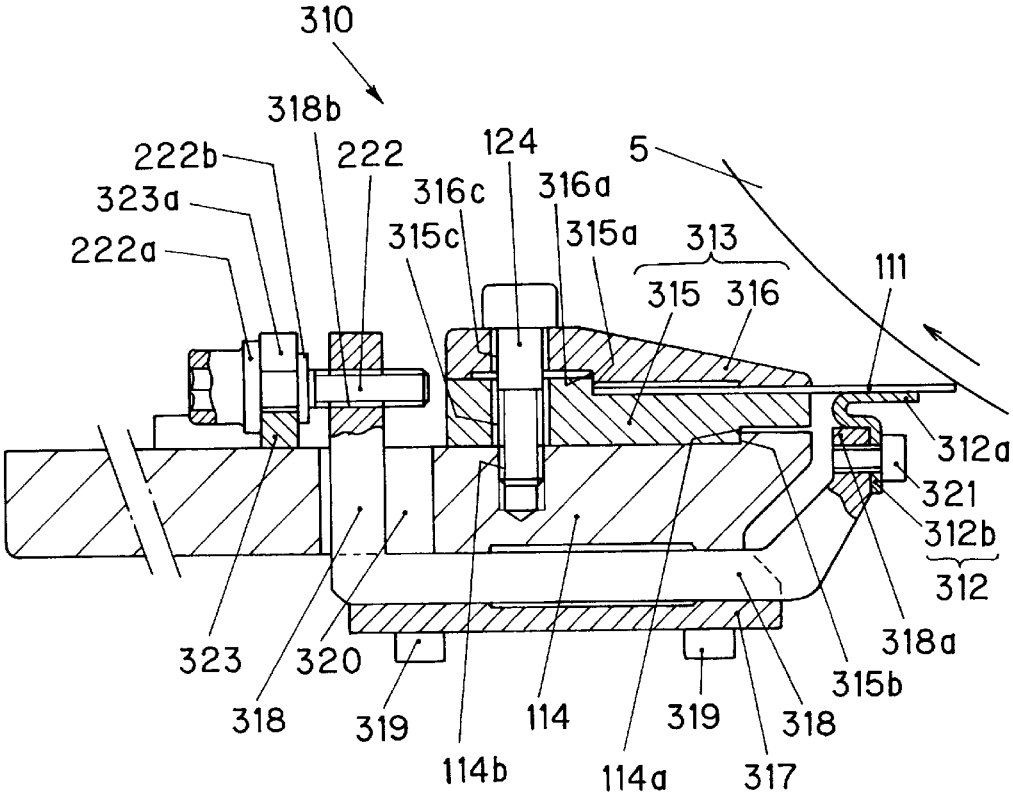
FIG. 9 is a sectional view of a doctor blade apparatus according to a third embodiment of the present invention.
Figure 10:
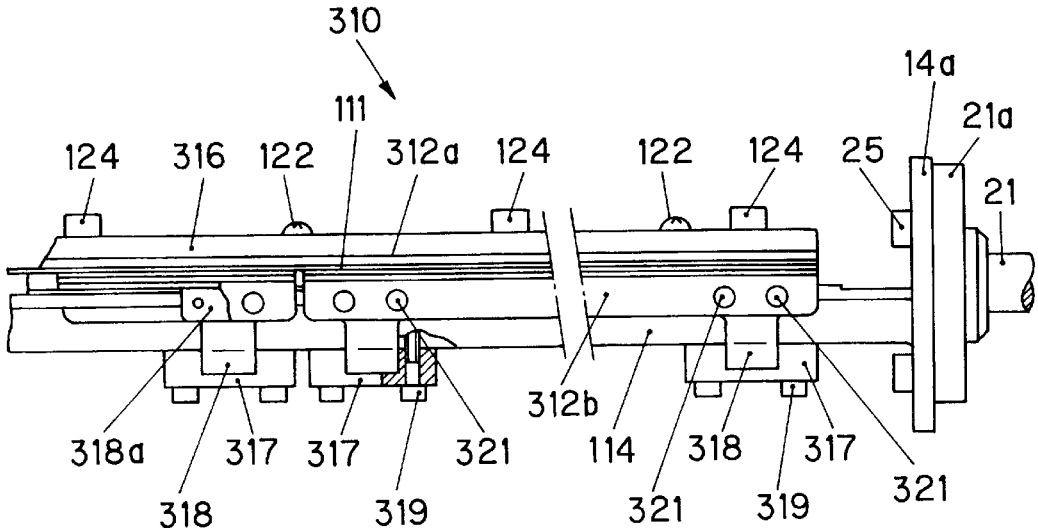
FIG. 10 is a partial front view of the doctor blade apparatus according to the third embodiment.

As shown in FIGS. 9 and 10, a doctor blade apparatus 310 includes a doctor blade 111, an elasticity-modifying member 312 which supports the doctor blade 111, a blade holder 313 for holding the doctor blade 111, a base 114 onto which the blade holder 313 is mounted, and reciprocal movement means for reciprocally moving the elasticity-modifying member 312.

The blade holder 313 includes a rest 315 and a holder plate 316, which are adapted to hold therebetween the doctor blade 111 having a length substantially identical to that of the metering roller 5 and which are substantially as long as the doctor blade 111.

The rest 315 assumes the form of a thick plate. A stepped portion 315*a* extending in the axial direction of the metering roller 5 is formed on the upper surface of the rest 315 such that the rear (left-hand in FIG. 9) region of the upper surface having a width about ⅓ that of the upper surface is higher than the front (right-hand in FIG. 9) remaining region. The lower surface of the rest 315, which is placed on the upper surface of the base 114, has a stepped portion 315*b* formed in a front region thereof. The stepped portion 315*b* abuts a front positioning portion 114*a* of the base 114 which assumes a stepped form projecting upward from a front region of the upper surface of the base 114 and extending in the axial direction of the metering roller 5.

The holder plate 316 assumes the form of a thick plate whose face matches the upper surface of the rest 315. In the holder plate 316, the rear (left-hand in FIG. 9) region of the upper surface having a width about ⅓ that of the upper surface is planar, whereas the front (right-hand in FIG. 9) remaining region slopes downward. A stepped portion 316*a* is formed on the lower surface of the holder plate 316 and abuts the stepped portion 315*a* formed on the upper surface of the rest 315 so that the lower surface of the holder plate 316 rests on the upper surface of the rest 315.

The doctor blade 111 is placed on a front region of the upper surface of the rest 315. The holder plate 316 is placed on the doctor blade 111 with its stepped portion 316*a* abutting the stepped portion 315*a* of the rest 315. As in the case of the first embodiment, the doctor blade 111 is positioned through fitting of a positioning pin (not shown) of the rest 315 into a positioning hole (not shown) formed in the doctor blade 111.

In the rest 315 and the holder plate 316, which are superposed on each other, an appropriate number of bolt holes are arranged in a rear region of the holder plate 316 at certain intervals and in the axial direction of the metering roller 5, and threaded holes opens in a rear region of the upper surface of the rest 315 and are arranged at positions corresponding to the bolt holes. Assembly bolts 122 are inserted into the respective bolt holes and are tightened into the respective threaded holes to thereby assemble the rest 315 and the holder plate 316 into a single unit; thus, the doctor blade 111 is held in a gap formed between front regions of the rest 315 and the holder plate 316.

The blade holder 313 is assembled while holding the doctor blade 111 as described above and is positioned through abutting of the stepped portion 315*b* formed on the lower surface of the rest 315 and the front positioning portion 114*a* of the base 114 and through abutting of the opposite sides thereof and the positioning pins 123 projecting from the upper surface of the base 114. The blade holder 313 is fixedly attached onto the base 114 by insertion of mounting bolts 124 through bolt holes 315*c* and 316*c* formed in the rest 315 and the holder plate 316, respectively, and by tightening of the mounting bolts 124 into threaded holes 114*b* formed in the base 114. The bolt holes 315*c* and 316*c* vertically extend through the rest 315 and the holder plate 316, respectively, and are arranged in the rear regions of the rest 315 and the holder plate 316, respectively, at certain intervals and along the axial direction of the metering roller 5. The threaded holes 114*b* are arranged in a central region of the upper surface of the base 114 at certain intervals and along the axial direction of the metering roller 5.

The elasticity-modifying member 312 and the reciprocal movement means for reciprocally moving the elasticity-modifying member 312 are configured in the following manner.

The elasticity-modifying member 312 has a length identical to that of the doctor blade 111 and is bent so as to form a support portion 312*a* and a mounting portion 312*b* as shown in FIG. 9.

Several, for example, paired guide members 317 each having a section shaped in a lying squarish letter U are mounted on the lower surface of the base 114 through use of mounting bolts 319. The guide members 317 are arranged apart from each other in the axial direction of the metering roller 5 at an appropriate interval shorter than the length of the elasticity-modifying member 312 and symmetrically with respect to the centerline of the doctor blade 111 mounted on the base 114. The guide members 317 are also arranged in parallel with each other and are oriented in the front-rear direction. The guide member 317 and the lower surface of the base 114 define a guide hole. An elliptic through-hole 320 is formed in the base 114 at a position corresponding to a rear end portion of the guide member 317 and on the rear side of the blade holder 313 mounted on the base 114. The through-hole 320 extends vertically through the base 114, and the major axis thereof is oriented in the front-rear direction.

Reciprocally moving members 318 each having a bar form are slidably inserted into the corresponding guide holes defined by the guide members 317 with an appropriate friction effected. Each reciprocally moving member 318 projects forward from each guide hole and is bent obliquely upward. A front upper end portion 318*a* of the reciprocally moving member 318 has a shape of a letter T and is located ahead of the front end portion of the base 114. A rear portion of the reciprocally moving member 318 projects upward from the guide hole, extends through the through-hole 320, and projects upward from the upper surface of the base 114. A threaded hole 318*b* is formed in the front-rear direction in a rear end portion of the reciprocally moving member 318 projecting upward from the upper surface of the base 114 and extends toward the blade holder 313.

Opposite end sections of the mounting portion 312*b* of the elasticity-modifying member 312 are attached onto the front surfaces of the letter-T-shaped upper end portions 318*a* of the paired reciprocally moving members 318 through use of mounting bolts 321. The support portion 312*a* of the elasticity-modifying member 312 supports the lower surface of the doctor blade 111 held by the blade holder 313 along the entire length of the doctor blade 111.

A bracket 323 having a letter-U-shaped groove 323*a* formed in an upright portion is provided on the upper surface of the base 114 and is located on the rear side of the through-hole 320. A portion of a flanged bolt 222 extending between flanges 222*a* and 222*b* is fitted into the letter-U-shaped groove 323*a*. The flanged bolt 222 is in screw-engagement with a threaded hole 318*b* formed in a rear end portion of the reciprocally moving member 318. A head portion of the flanged bolt 222 is adapted to engage a rotating tool so as to serve as an operation end.

In the case where the doctor blade 111 extends substantially along the entire axial length of the metering roller 5, and the elasticity-modifying member 312 is of a split type in which a plurality of elasticity-modifying members 312 are provided along the longitudinal direction of the doctor blade 111, the paired reciprocally moving members 318 are assigned to each elasticity-modifying member 312 so that the elasticity-modifying members 312 can be reciprocally moved independently of each other.

In the above doctor blade apparatus 310, when the head portion, i.e., the working end of each flanged bolt 222, is rotated for adjustment through use of an appropriate tool, the flanged bolt 222 rotates in a regular direction or in reverse while being restricted in axial displacement by the bracket 323. Accordingly, the reciprocally moving members 318 screw-engaged with the flanged bolts 222 appropriately advance or retreat while being guided by the guide members 317.

Since the elasticity-modifying member 312 is attached to the upper end portions 318*a* of the paired reciprocally moving members 318, the elasticity-modifying member 312 is advanced or retreated along the lower side of the doctor blade 111. Thus, the position of the tip edge of the support portion 312*a* of the elasticity-modifying member 312 is adjusted in the front-rear direction and with respect to the edge of the doctor blade 111. In this connection, as shown in FIG. 2B, the edge of the doctor blade 111 is pressed against the circumferential surface of the rotating metering roller 5 and is deflected accordingly; and the tip edge of the support portion 312*a* of the elasticity-modifying member 312 supports the deflection side of the doctor blade 111.

Thus is adjusted the elastic force of the doctor blade 111, i.e., a force at which the edge of the doctor blade 111 is pressed against the circumferential surface of the metering roller 5.

A doctor blade apparatus according to a fourth embodiment of the present invention will next be described.

Figure 11:
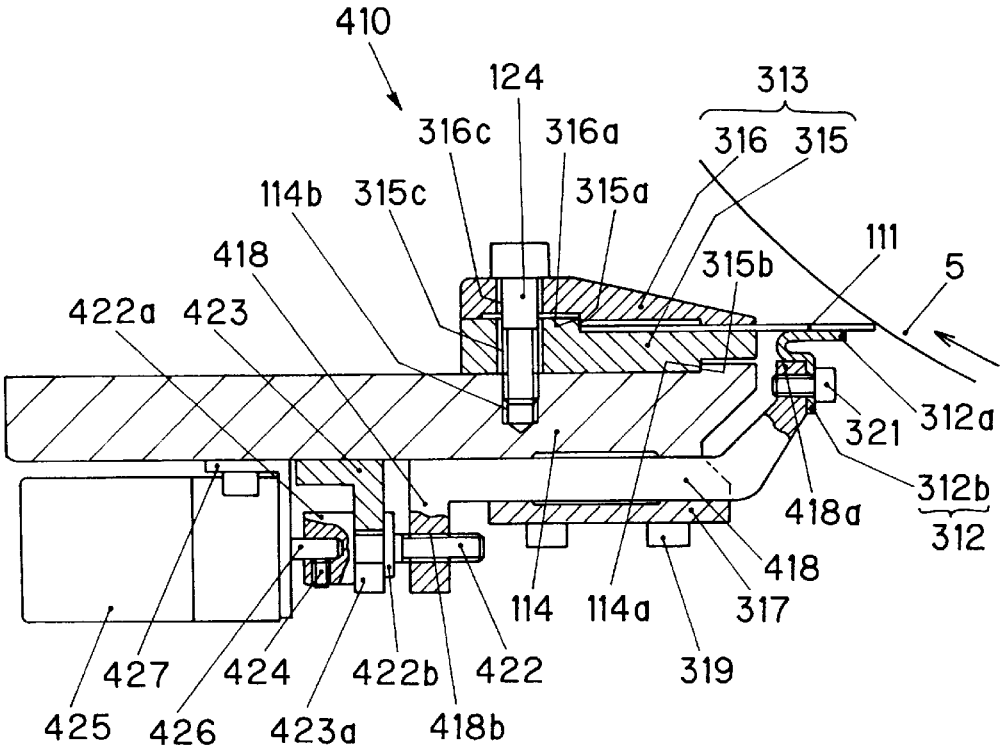
FIG. 11 is a sectional view of a doctor blade apparatus according to a fourth embodiment of the present invention.
Figure 12:
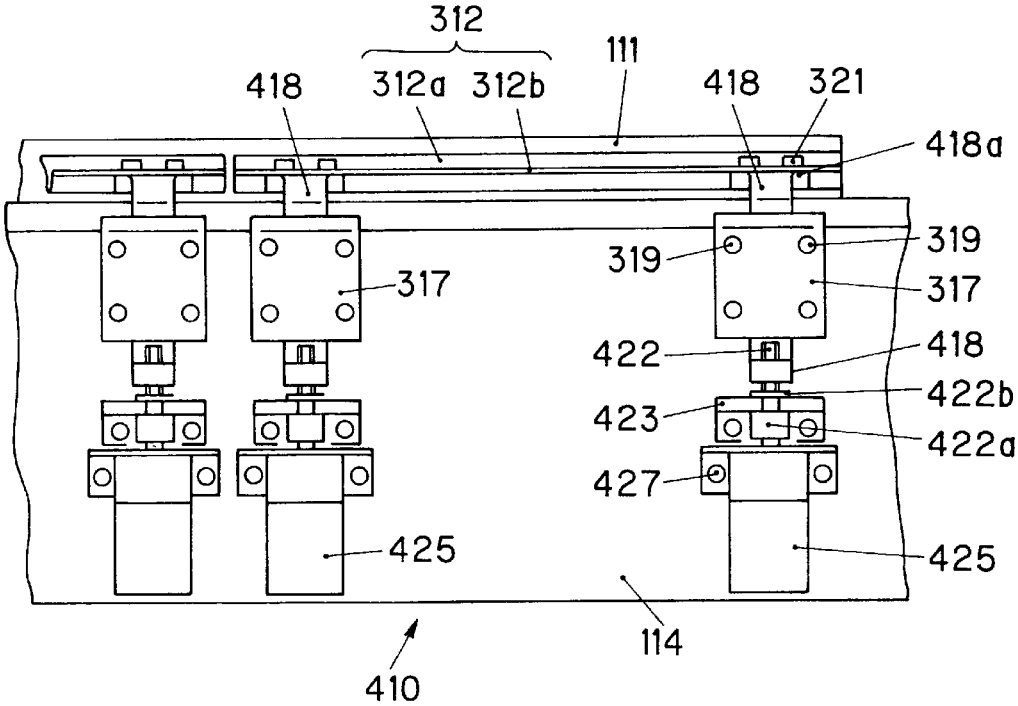
FIG. 12 is a partial bottom view of the doctor blade apparatus according to the fourth embodiment.

As shown in FIGS. 11 and 12, a doctor blade apparatus 410 includes a doctor blade 111, an elasticity-modifying member 312 which supports the doctor blade 111, a blade holder 313 for holding the doctor blade 111, a base 114 onto which the blade holder 313 is mounted, and reciprocal movement means for reciprocally moving the elasticity-modifying member 312.

The doctor blade apparatus of the present embodiment the same as that of the third embodiment except for the reciprocal movement means for reciprocally moving the elasticity-modifying member 312. (The base the same as that of the first embodiment).

The reciprocal movement means for reciprocally moving the elasticity-modifying member 312 is configured in the following manner.

Several, for example, paired guide members 317 each having a section shaped in a lying squarish letter U are mounted on the lower surface of the base 114 through use of mounting bolts 319. The guide members 317 are arranged apart from each other in the axial direction of the metering roller 5 at an appropriate interval shorter than the length of the elasticity-modifying member 312 and symmetrically with respect to the centerline of the doctor blade 111 mounted on the base 114. The guide members 317 are also arranged in parallel with each other and are oriented in the front-rear direction. The guide member 317 and the lower surface of the base 114 define a guide hole.

Reciprocally moving members 418 each having a bar form are slidably inserted into the corresponding guide holes defined by the guide members 317 with an appropriate friction effected. Each reciprocally moving member 418 projects forward from each guide hole and is bent obliquely upward. A front upper end portion 418*a* of the reciprocally moving member 418 has a shape of a letter T and is located ahead of the front end portion of the base 114. A rear portion of the reciprocally moving member 418 projects rearward from the guide hole and is bent downward. A threaded hole 418*b* is formed in the front-rear direction in a lower end portion of the reciprocally moving member 418.

Opposite end sections of the mounting portion 312*b* of the elasticity-modifying member 312 are attached onto the front surfaces of the letter-T-shaped upper end portions 418*a* of the paired reciprocally moving members 418 through use of mounting bolts 321. The support portion 312*a* of the elasticity-modifying member 312 supports the lower surface of the doctor blade 111 held by the blade holder 313 along the entire length of the doctor blade 111.

A bracket 423 having a letter-U-shaped groove 423*a* formed in an upright portion is provided on the lower surface of the base 114 for each reciprocally moving member 418. A portion of a flanged bolt 422 extending between a head 422*a* and a flange 422*b* is fitted into the letter-U-shaped groove 423*a*. The flanged bolt 222 is in screw-engagement with a threaded hole 418*b* formed in a rear end portion of the reciprocally moving member 418.

Several, for example, paired control motors 425 corresponding to several, for example, paired reciprocally moving members 418 are mounted on the lower surface of the base 114 through use of fixtures 427. The control motors 425 are arranged at an interval corresponding to that of the reciprocally moving members 418 and in the axial direction of the metering roller 5. An output shaft 426 of the control motor 425 is engaged with the head 422*a* of the flanged bolt 422 by means of a set screw 424. That is, paired control motors 425 are provided for each elasticity-modifying member 312.

When the control motors 425 are synchronously operated under control effected by unillustrated control means, the flanged bolt 422 connected to each output shaft 426 rotates in a regular direction or in reverse while being restricted in axial displacement by the bracket 423. Accordingly, the reciprocally moving members 418 screw-engaged with the flanged bolts 422 appropriately advance or retreat while being guided by the guide members 317.

Since opposite end portions of the elasticity-modifying member 312 are attached to the front end portions 418*a* of the paired reciprocally moving members 418, the elasticity-modifying member 312 is advanced or retreated along the lower side of the doctor blade 111. Thus, the position of the tip edge of the support portion 312*a* of the elasticity-modifying member 312 is adjusted in the front-rear direction and with respect to the edge of the doctor blade 111. In this connection, as shown in FIG. 2B, the edge of the doctor blade 111 is pressed against the circumferential surface of the rotating metering roller 5 and is deflected accordingly; and the tip edge of the support portion 312*a* of the elasticity-modifying member 312 supports the deflection side of the doctor blade 111.

In this case, the doctor blade 111 which is pressed at its edge abuts at its rear end the stepped portion 315*a* of the rest 315, and is thus positionally fixed. The elasticity-modifying member 312 is pressed by the downwardly deflecting doctor blade 111 and is thus positionally fixed.

Thus is adjusted the elastic force of the doctor blade 111, i.e., a force at which the edge of the doctor blade 111 is pressed against the circumferential surface of the metering roller 5.

A doctor blade apparatus according to a fifth embodiment of the present invention will next be described.

Figure 13:
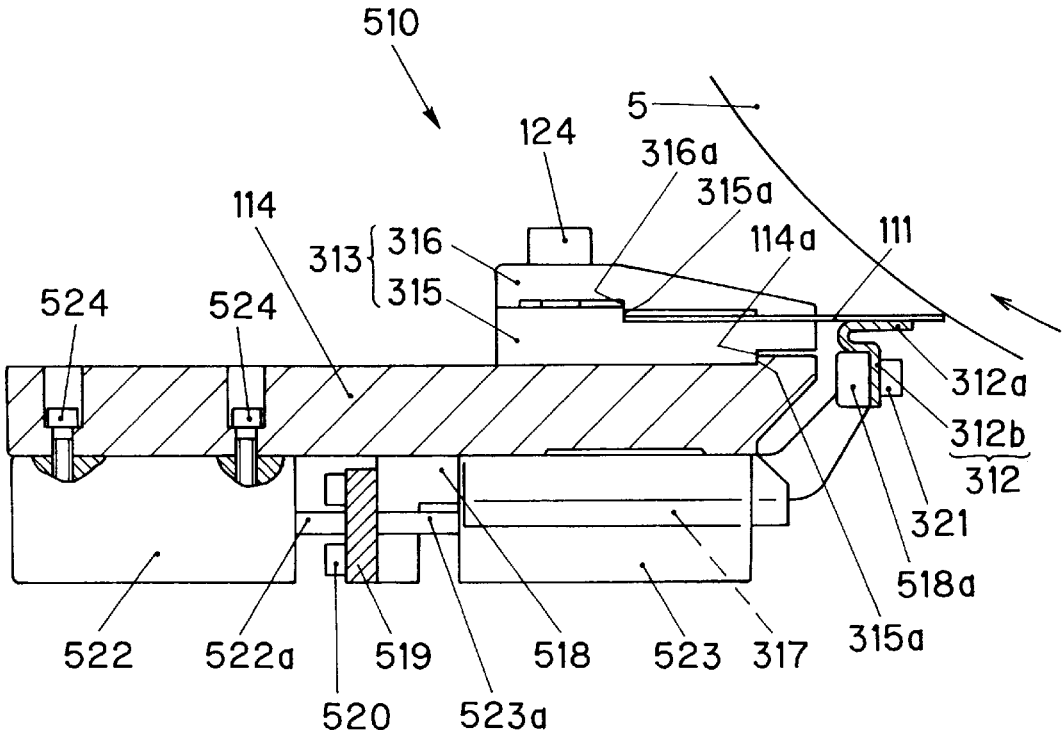
FIG. 13 is a sectional view of a doctor blade apparatus according to a fifth embodiment of the present invention.
Figure 14:
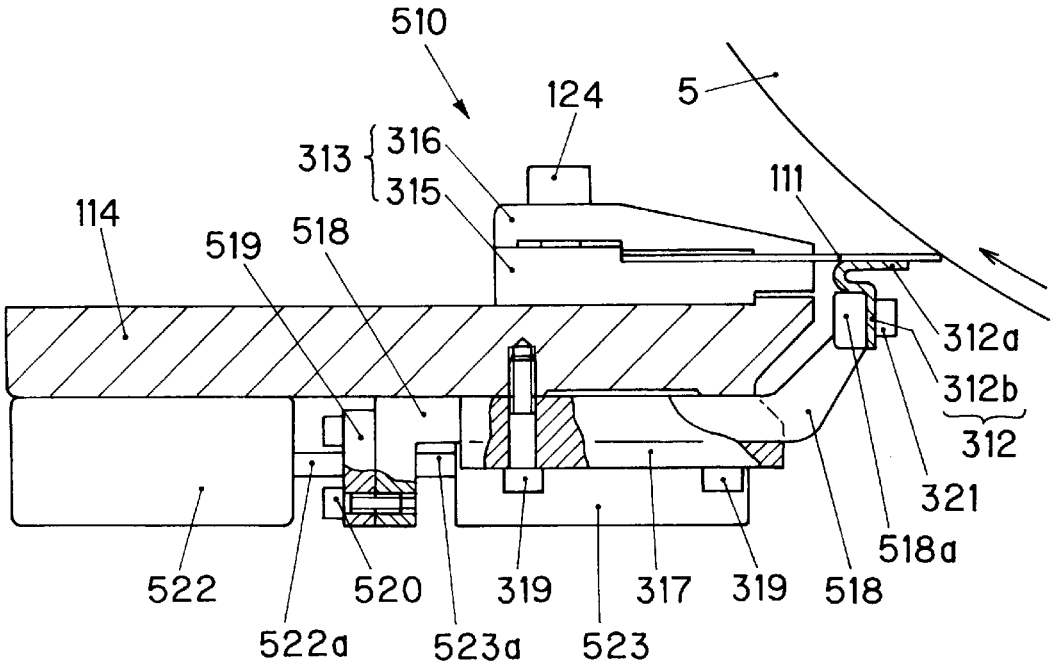
FIG. 14 is a sectional view of the doctor blade apparatus according to the fifth embodiment.
Figure 15:
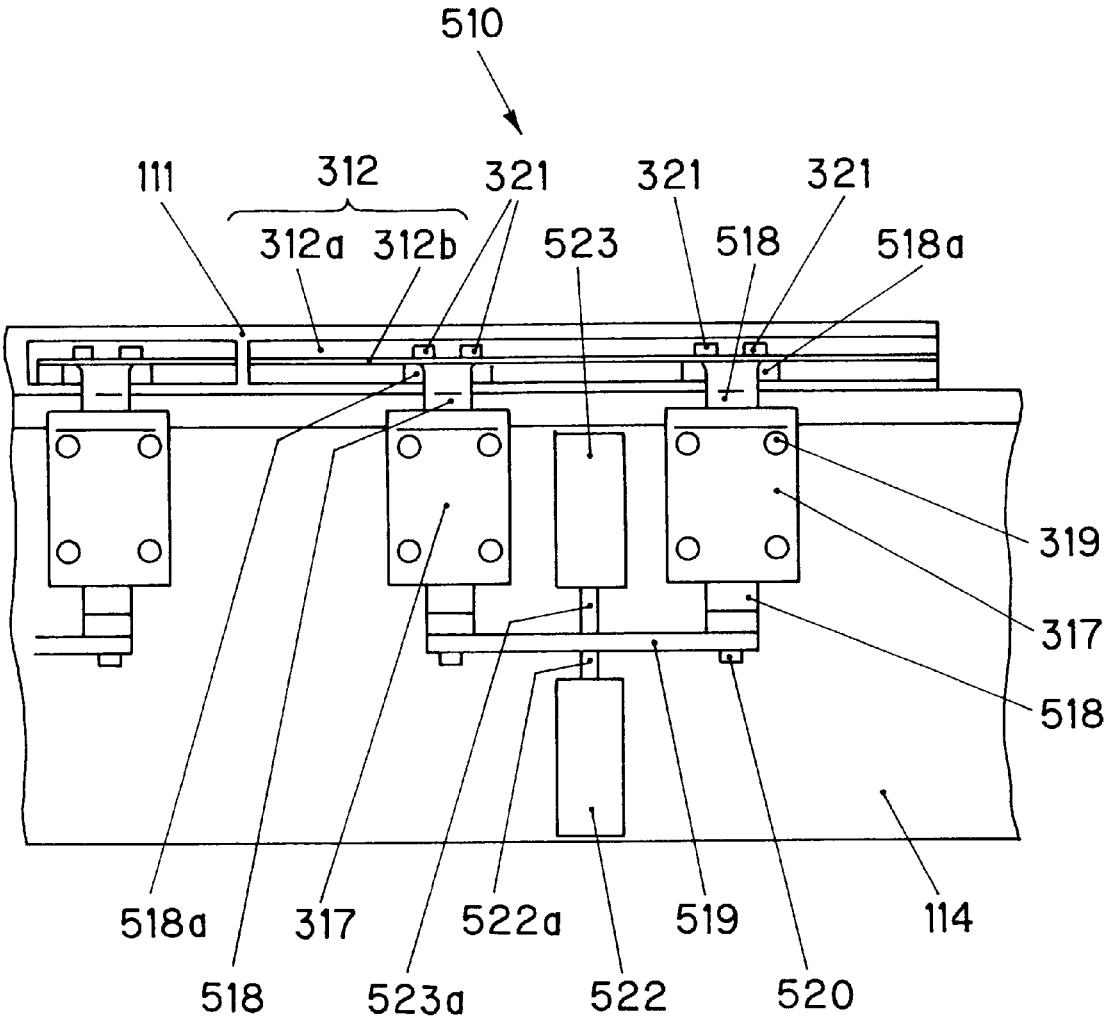
FIG. 15 is a partial bottom view of the doctor blade apparatus according to the fifth embodiment.

As shown in FIGS. 13, 14, and 15, a doctor blade apparatus 510 includes a doctor blade 111, an elasticity-modifying member 312 which supports the doctor blade 111, a blade holder 313 for holding the doctor blade 111, a base 114 onto which the blade holder 313 is mounted, and reciprocal movement means for reciprocally moving the elasticity-modifying member 312.

The doctor blade apparatus of the present embodiment the same as that of the third embodiment except for the reciprocal movement means for reciprocally moving the elasticity-modifying member 312. (The base the same as that of the first embodiment).

The reciprocal movement means for reciprocally moving the elasticity-modifying member 312 is configured in the following manner.

Several, for example, paired guide members 317 each having a section shaped in a lying squarish letter U are mounted on the lower surface of the base 114 through use of mounting bolts 319. The guide members 317 are arranged apart from each other in the axial direction of the metering roller 5 at an appropriate interval shorter than the length of the elasticity-modifying member 312 and symmetrically with respect to the centerline of the doctor blade 111 mounted on the base 114. The guide members 317 are also arranged in parallel with each other and are oriented in the front-rear direction. Each guide member 317 and the lower surface of the base 114 define a guide hole.

Reciprocally moving members 518 each having a bar form are slidably inserted into the corresponding guide holes defined by the paired guide members 317 with an appropriate friction effected. Each reciprocally moving member 518 projects forward from each guide hole and is bent obliquely upward. A front upper end portion 518*a* of the reciprocally moving member 518 has a shape of a letter T and is located ahead of the front end portion of the base 114. A rear portion of the reciprocally moving member 518 projects rearward from the guide hole and is bent downward.

Downwardly-extending lower rear end portions of the paired reciprocally moving members 518 are attached to opposite end portions of a connecting member 519 by means of bolts 520.

Opposite end sections of the mounting portion 312*b* of the elasticity-modifying member 312 are attached onto the front surfaces of the letter-T-shaped upper end portions 518*a* of the paired reciprocally moving members 518 through use of mounting bolts 321. The support portion 312*a* of the elasticity-modifying member 312 supports the lower surface of the doctor blade 111 held by the blade holder 313 along the entire length of the doctor blade 111.

Paired piezoelectric actuators 522 and 523 are mounted on the lower surface of the base 114 by means of mounting bolts 524 so as to be located in a facing manner on the centerline of the elasticity-modifying member 312. Actuating members 522*a* and 523*a* projecting from the opposed piezoelectric actuators 522 and 523, respectively, hold a central portion of the connecting member 519 from front and rear sides.

In the case where the doctor blade 111 extends substantially along the entire axial length of the metering roller 5, and the elasticity-modifying member 312 is of a split type in which a plurality of elasticity-modifying members 312 are provided along the longitudinal direction of the doctor blade 111, the paired reciprocally moving members 518 are assigned to each elasticity-modifying member 312 so that the elasticity-modifying members 312 can be reciprocally moved independently of each other.

When either of the piezoelectric actuators 522 and 523 is selectively operated under control effected by unillustrated control means, the corresponding actuating member 522*a* or 523*a* moves, so that the connecting member 519, i.e., the reciprocally moving members 518, appropriately advance or retreat.

Accordingly, the elasticity-modifying member 312 is advanced or retreated along the lower side of the doctor blade 111. Thus, the position of the tip edge of the support portion 312*a* of the elasticity-modifying member 312 is adjusted in the front-rear direction and with respect to the edge of the doctor blade 111. In this connection, as shown in FIG. 2B, the edge of the doctor blade 111 is pressed against the circumferential surface of the rotating metering roller 5 and is deflected accordingly; and the tip edge of the support portion 312*a* of the elasticity-modifying member 312 supports the deflection side of the doctor blade 111.

In this case, the doctor blade 111 which is pressed at its edge abuts at its rear end the stepped portion 315*a* of the rest 315, and is thus positionally fixed. The elasticity-modifying member 312 is pressed by the downwardly deflecting doctor blade 111 and is thus positionally fixed.

Thus is adjusted the elastic force of the doctor blade 111, i.e., a force at which the edge of the doctor blade 111 is pressed against the circumferential surface of the metering roller 5.

A doctor blade apparatus according to a sixth embodiment of the present invention will next be described.

Figure 16:
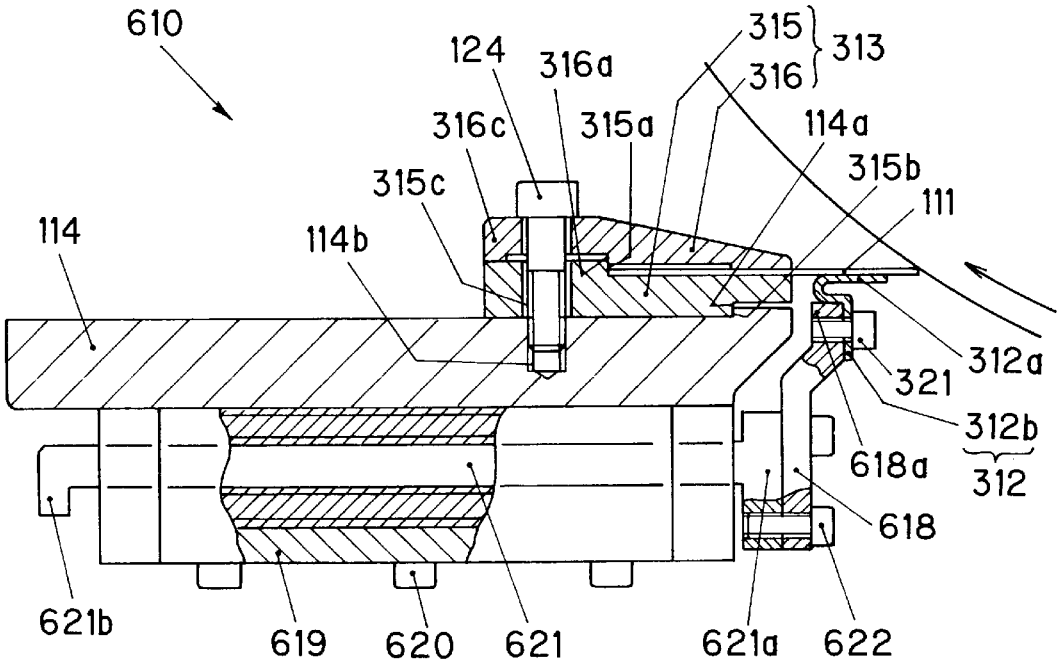
FIG. 16 is a sectional view of a doctor blade apparatus according to a sixth embodiment of the present invention.
Figure 17:
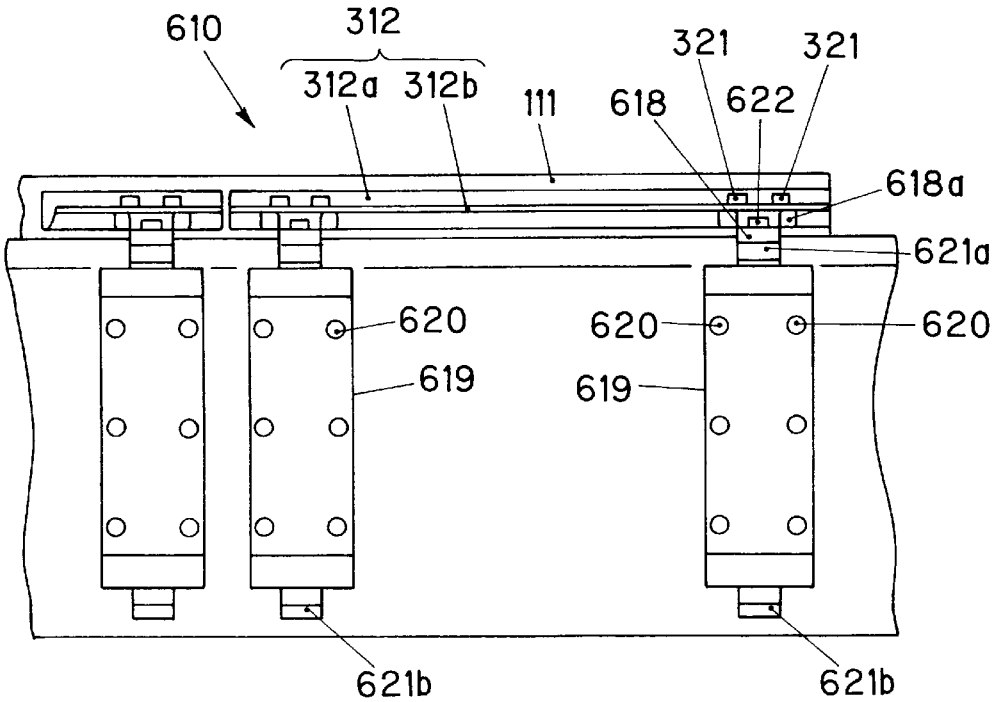
FIG. 17 is a partial bottom view of the doctor blade apparatus according to the sixth embodiment.

As shown in FIGS. 16 and 17, a doctor blade apparatus 610 includes a doctor blade 111, an elasticity-modifying member 312 which supports the doctor blade 111, a blade holder 313 for holding the doctor blade 111, a base 114 onto which the blade holder 313 is mounted, and reciprocal movement means for reciprocally moving the elasticity-modifying member 312.

The doctor blade apparatus of the present embodiment the same as that of the third embodiment except for the reciprocal movement means for reciprocally moving the elasticity-modifying member 312. (The base the same as that of the first embodiment).

The reciprocal movement means for reciprocally moving the elasticity-modifying member 312 is configured in the following manner.

Several, for example, paired ultrasonic linear motors 619 are mounted on the lower surface of the base 114 through use of mounting bolts 620. The ultrasonic linear motors 619 are arranged apart from each other in the axial direction of the metering roller 5 at an appropriate interval shorter than the length of the elasticity-modifying member 312 and symmetrically with respect to the centerline of the doctor blade 111 mounted on the base 114. The ultrasonic linear motors 619 are also arranged in parallel with each other and are oriented in the front-rear direction. In the ultrasonic linear motor 619 controlled by unillustrated control means, a linearly movable core 621 has a front end flange 621*a* and a rear end bend 621*b* formed at projecting opposite ends. The front end flange 621*a* serves as a stopper for retreating movement, and the rear end bend 621*b* serves as a stopper for advancing movement.

A reciprocally moving member 618 has its lower end portion attached onto the front surface of the front end flange 621*a* of each linearly movable core 621 and extends upright. An upper end portion 618*a* of the reciprocally moving member 618 has a shape of a letter T and is located ahead of the front end portion of the base 114. Opposite end sections of the mounting portion 312*b* of the elasticity-modifying member 312 are attached onto the front surfaces of the letter-T-shaped upper end portions 618*a* of the paired reciprocally moving members 618 through use of mounting bolts 321. The support portion 312*a* of the elasticity-modifying member 312 supports the lower surface of the doctor blade 111 held by the blade holder 313 along the entire length of the doctor blade 111.

In the case where the doctor blade 111 extends substantially along the entire axial length of the metering roller 5, and the elasticity-modifying member 312 is of a split type in which a plurality of elasticity-modifying members 212 are provided along the longitudinal direction of the doctor blade 111, the paired reciprocally moving members 618 are assigned to each elasticity-modifying member 312 so that the elasticity-modifying members 312 can be reciprocally moved independently of each other.

When the paired ultrasonic linear motors 619 are operated under control effected by unillustrated control means, the linearly movable cores 621, together with the reciprocally moving members 618, advance or retreat at fine steps. Accordingly, the elasticity-modifying member 312 is advanced or retreated along the lower side of the doctor blade 111. Thus, the position of the tip edge of the support portion 312*a* of the elasticity-modifying member 312 is adjusted in the front-rear direction and with respect to the edge of the doctor blade 111. In this connection, as shown in FIG. 2B, the edge of the doctor blade 111 is pressed against the circumferential surface of the rotating metering roller 5 and is deflected accordingly; and the tip edge of the support portion 312*a* of the elasticity-modifying member 312 supports the deflection side of the doctor blade 111.

In this case, the doctor blade 111 which is pressed at its edge abuts at its rear end the stepped portion 315*a* of the rest 315, and is thus positionally fixed. The elasticity-modifying member 312 is pressed by the downwardly deflecting doctor blade 111 and is thus positionally fixed.

Thus is adjusted the elastic force of the doctor blade 111, i.e., a force at which the edge of the doctor blade 111 is pressed against the circumferential surface of the metering roller 5.

In the doctor blade apparatuses of the above-described embodiments, the position of the tip edge of the elasticity-modifying member 112, 212, or 312 is adjusted in the front-rear direction and with respect to the edge of the doctor blade 111. Thus is adjusted the elastic force of the doctor blade 111, i.e., a force at which the edge of the doctor blade 111 is pressed against the circumferential surface of the metering roller 5. As a result, the amount of ink to be scraped off by the doctor blade 111 is increasingly or decreasingly adjusted all at once over the axial length of the metering roller 5, thereby increasingly or decreasingly adjusting an inking amount in a concurrent manner and without impairing intrinsic advantages of a keyless inking arrangement and thus adjusting printing density.

In a printing machine permitting allotment of individual page images to a plurality of corresponding substantially equally divided regions of a plate cylinder as viewed along the axial direction of the plate cylinder, such as a rotary press for printing newspaper, the elasticity-modifying member 112, 212, or 312 of a split type may be employed.

In this case, the positions of the tip edges of the elasticity-modifying members 112, 212, or 312 are adjusted independently of each other in the front-rear direction and with respect to the edge of the doctor blade 111. Accordingly, a force at which the edge of the doctor blade 111 is pressed against the circumferential surface of the metering roller 5 is adjusted according to each of the elasticity-modifying members. Thus, a total inking amount is modified for each of the divided regions, thereby adjusting printing density appropriately.

In the present invention, through modification of a force at which the edge of the doctor blade is pressed against the circumferential surface of the metering roller, the state of scraping ink off the circumferential surface of the metering roller is modified in the following manner.

The ink I supplied from the ink fountain 1 is transferred in the sequence of the rotating fountain roller 2, the rotating transfer roller 3, the rotating intermediate roller 4, and the rotating metering roller 5. The amount of ink transferred onto the circumferential surface of the metering roller 5 is sufficient to obtain optimum printing density. The circumferential surface of the metering roller 5 has numerous fine pits and projections formed thereon in order to appropriately receive ink.

The ink transferred onto the circumferential surface of the metering roller adheres to the surface through entry into the numerous fine pits formed on the surface.

The ink is a kind of viscous fluid or viscoelastic fluid and has considerably high viscosity as compared to water. This highly viscous feature enables the ink to bite into the numerous fine pits formed on the surface and to entangle itself with the numerous fine projections formed on the surface, so that the ink securely adheres to the circumferential surface of the metering roller.

The ink adhering to the circumferential surface of the rotating metering roller 5 and having properties of a viscous or viscoelastic fluid is zero in relative speed with respect to the circumferential surface of the metering roller and assumes the form of a so-called boundary layer as known in hydrodynamics. Accordingly, the adhering ink including that caught in the numerous fine pits passes under the edge of the doctor blade.

As will be revealed through close observation of the doctor blade edge pressed against the circumferential surface of the metering roller by an appropriate elastic force, the edge pressed against the roller surface has a fine width (hereinafter referred to as edge width) as measured in the circumferential direction of the metering roller, i.e., a certain area.

In connection with the fact that as the metering roller rotates, the adhering ink assumes the form of a boundary layer and passes under the edge of the doctor blade pressed against the metering roller, the ink passes under the doctor blade edge against a force (F) at which the edge is pressed against the metering roller. Thus, pressure (P) which balances with the force (F) is generated within the ink layer.

"Stokes' approximation" ("Basics A5 ydrodynamic Engineering," *Handbook of Mechanical Engineering* (The Japan Society of Mechanical Engineers, First Impression of First Edition, Apr., 7, 1986), pp. 37–39) holds for the pressure (P). With viscosity of ink taken as $\mu$, peripheral speed of metering roller taken as U, edge width taken as L, and gap forcibly formed by passing ink between doctor blade and metering roller (thickness of passing ink layer) taken as H, the following relation holds.

$$P\ \mu \times U \times L/H^2 \tag{1}$$

The thickness of the ink layer passing under the edge of the doctor blade is obtained from the relation represented above and is expressed as follows.

$$H \propto \sqrt{(\mu \times U \times L/P)} \tag{2}$$

As mentioned above, when the ink passes under the edge of the doctor blade, the pressure (P) generated within the passing ink layer balances with the force (F) at which the doctor blade is pressed against the metering roller, i.e., P=F. Thus, the above expression (2) becomes as follows.

$$H \propto \sqrt{(\mu \times U \times L/F)} \tag{3}$$

Accordingly, in the present invention, when the viscosity of ink ($\mu$), the peripheral speed of the metering roller (U), and the edge width (L) are constant, by varying of the elastic force of the doctor blade to thereby vary the force (F) at which the doctor blade is pressed against the metering roller, the thickness of the passing ink layer, i.e., the amount of ink, can be varied. Also, according to the present invention, even when the thickness of the passing ink layer varies due to variation in the viscosity of ink ($\mu$), the peripheral speed of the metering roller (U), or the edge width (L), by varying of the elastic force of the doctor blade to thereby vary the force at which the doctor blade is pressed against the metering roller, the thickness of the passing ink layer, i.e., the amount of ink, can be maintained at a proper level.

In the above first, second, and third embodiments, the reciprocal movement means is of manual operation. In this case, when a plurality of reciprocal movement means are assigned to a single elasticity-modifying member, these reciprocal movement means can be reciprocally moved in unison through employment of unillustrated mechanical drive means, such as gear mechanism or timing belt transmission mechanism, enabling a worker to operate the cam mechanisms and the screw mechanisms by means of a single operation handle.

Particularly, in the second and third embodiments wherein paired reciprocally moving members 218 and 318, respectively, are assigned to a single elasticity-modifying member, instead of using the screw mechanisms, a rack may be formed on each of the left-hand end portions in FIGS. 7 and 9. Pinions which engage the corresponding racks are mounted on a common drive shaft disposed in parallel with the axial direction of the metering roller 5. Thus, through rotation of the drive shaft, the reciprocally moving members 218 (318) are concurrently advanced or retreated.

In the fourth embodiment wherein the reciprocal movement means is driven by the control motors, the paired control motors may be replaced with a single control motor, and the driving action of the control motor may be transmitted to the paired screw mechanisms through use of a timing belt transmission mechanism.

What is claimed is:

1. A doctor blade apparatus in which a doctor blade is pressed against a metering roller provided in an inking train of a printing apparatus and scrapes off an excess portion of ink transferred onto a circumferential surface of the metering roller, comprising:

a blade holder attached to a base which moves toward and away from the metering roller;

a doctor blade held by said blade holder and extending along substantially the entire axial length of the metering roller;

an elasticity-modifying member abutting, along the longitudinal direction of said doctor blade, a deflection-side surface of said doctor blade whose edge is pressed against the circumferential surface of the metering roller and deflects accordingly, said elasticity-modifying member being reciprocally movable toward and away from the edge of said doctor blade; and reciprocal movement means for reciprocally moving said elasticity-modifying member toward and away from the edge of said doctor blade.

2. A doctor blade apparatus according to claim 1, wherein said elasticity-modifying member is in the form of a plate held, together with said doctor blade, by said blade holder and restrictedly guided for reciprocal movement toward and away from the edge of said doctor blade, and wherein said reciprocal movement means is reciprocally driving means provided on said blade holder and directly linked to said elasticity-modifying member.

3. A doctor blade apparatus according to claim 1, wherein said elasticity-modifying member is in the form of a plate held, together with said doctor blade, by said blade holder and restrictedly guided for reciprocal movement toward and away from the edge of said doctor blade, and wherein said reciprocal movement means comprises a reciprocally moving member whose tip is linked to said elasticity-modifying member and which can move reciprocally toward and away from the edge of said doctor blade, and reciprocally driving means for reciprocally driving said reciprocally moving member toward and away from the edge of said doctor blade.

4. A doctor blade apparatus according to claim 1, wherein said elasticity-modifying member is of a narrow form extending in the longitudinal direction of said doctor blade and abuts merely a projected edge portion of said doctor blade held by said blade holder, and wherein said reciprocal movement means comprises a reciprocally moving member whose tip is linked to said elasticity-modifying member and which can move reciprocally toward and away from the edge of said doctor blade, and reciprocally driving means for reciprocally driving said reciprocally moving member toward and away from the edge of said doctor blade.

5. A doctor blade apparatus according to claim 2, wherein said reciprocally driving means comprises a cam mechanism.

6. A doctor blade apparatus according to claim 3, wherein said reciprocally driving means comprises a screw mechanism.

7. A doctor blade apparatus according to claim 4, wherein said reciprocally driving means comprises a screw mechanism.

8. A doctor blade apparatus according to claim 4, wherein said reciprocally driving means comprises a piezoelectric actuator.

9. A doctor blade apparatus according to claim 4, wherein said reciprocally driving means comprises an ultrasonic linear motor.

10. A doctor blade apparatus in which a doctor blade is pressed against a metering roller provided in an inking train of a printing apparatus and scrapes off an excess portion of ink transferred onto a circumferential surface of the metering roller, comprising:

a blade holder attached to a base which moves toward and away from the metering roller;

a doctor blade held by said blade holder and extending along substantially the entire axial length of the metering roller;

a plurality of elasticity-modifying members abutting, along the longitudinal direction of said doctor blade, a deflection-side surface of said doctor blade which extends along substantially the entire axial length of the metering roller and whose edge is pressed against the circumferential surface of the metering roller and deflects accordingly, said elasticity-modifying members being reciprocally movable toward and away from the edge of said doctor blade independently of each other; and reciprocal movement means for reciprocally moving said elasticity-modifying members toward and away from the edge of said doctor blade independently of each other.

11. A doctor blade apparatus according to claim 10, wherein said elasticity-modifying member is in the form of a plate held, together with said doctor blade, by said blade holder and restrictedly guided for reciprocal movement toward and away from the edge of said doctor blade, and wherein said reciprocal movement means is reciprocally driving means provided on said blade holder and directly linked to said elasticity-modifying member.

12. A doctor blade apparatus according to claim 10, wherein said elasticity-modifying member is in the form of a plate held, together with said doctor blade, by said blade holder and restrictedly guided for reciprocal movement toward and away from the edge of said doctor blade, and wherein said reciprocal movement means comprises a reciprocally moving member whose tip is linked to said elasticity-modifying member and which can move reciprocally toward and away from the edge of said doctor blade, and reciprocally driving means for reciprocally driving said reciprocally moving member toward and away from the edge of said doctor blade.

13. A doctor blade apparatus according to claim 10, wherein said elasticity-modifying member is of a narrow form extending in the longitudinal direction of said doctor blade and abuts merely a projected edge portion of said doctor blade held by said blade holder, and wherein said reciprocal movement means comprises a reciprocally moving member whose tip is linked to said elasticity-modifying member and which can move reciprocally toward and away from the edge of said doctor blade, and reciprocally driving means for reciprocally driving said reciprocally moving member toward and away from the edge of said doctor blade.

14. A doctor blade apparatus according to claim 11, wherein said reciprocally driving means comprises a cam mechanism.

15. A doctor blade apparatus according to claim 12, wherein said reciprocally driving means comprises a screw mechanism.

16. A doctor blade apparatus according to claim 13, wherein said reciprocally driving means comprises a screw mechanism.

17. A doctor blade apparatus according to claim 13, wherein said reciprocally driving means comprises a piezoelectric actuator.

18. A doctor blade apparatus according to claim 13, wherein said reciprocally driving means comprises an ultrasonic linear motor.

* * * * *